US005787680A

United States Patent [19]

Tisma et al.

[11] Patent Number: 5,787,680

[45] Date of Patent: Aug. 4, 1998

[54] HORIZONTAL CARTONER WITH VERTICALLY ARTICULATING PRODUCT TRAYS FOR MULTIPLE COUNTS/LAYERS OF WRAPPED PRODUCTS

[75] Inventors: Stevan Tisma, Elk Grove Village; Steven Zabran, Bartlett, both of Ill.

[73] Assignee: Tisma Machinery Corporation, Elk Grove Village, Ill.

[21] Appl. No.: 703,930

[22] Filed: Aug. 28, 1996

Related U.S. Application Data

[63] Continuation of Ser. No. 293,732, Aug. 19, 1994, abandoned, which is a continuation-in-part of Ser. No. 169,374, Dec. 17, 1993, Pat. No. 5,560,184.

[51] Int. Cl.[6] ..... B65B 05/06

[52] U.S. Cl. ..... 53/244; 53/247; 53/251; 53/252; 53/257; 53/529; 53/535; 53/537; 53/540

[58] Field of Search ..... 53/244, 245, 247, 53/250, 251, 252, 255, 257, 260, 523, 529, 531, 535, 537, 540, 500, 501, 495, 498

[56] References Cited

U.S. PATENT DOCUMENTS

| | | | |
|---|---|---|---|
| 2,853,177 | 9/1958 | Engleson et al. | 53/252 X |
| 3,810,344 | 5/1974 | Evans et al. | 53/252 X |
| 3,854,270 | 12/1974 | Cloud et al. | 53/252 X |
| 4,094,130 | 6/1978 | Kelly et al. | 53/529 |
| 4,712,356 | 12/1987 | Hardage et al. | 53/446 |
| 4,854,111 | 8/1989 | Roberts et al. | 53/535 X |
| 4,875,328 | 10/1989 | Meyer | 53/529 |
| 4,922,688 | 5/1990 | Langen et al. | 53/252 X |
| 5,072,573 | 12/1991 | Tisma | 53/257 X |
| 5,170,610 | 12/1992 | Tisma | 53/540 X |
| 5,185,984 | 2/1993 | Tisma | 53/257 X |

FOREIGN PATENT DOCUMENTS

| | | | |
|---|---|---|---|
| 1317102 | 5/1973 | United Kingdom | 53/535 |

*Primary Examiner*—Daniel Moon

*Attorney, Agent, or Firm*—Laff, Whitesel, Conte & Saret, Ltd.

[57] ABSTRACT

An automatic packaging machine is adapted to insert a plurality of layers of product into a carton. In a preferred embodiment, the product is carried in an X-Y tray which is able to expand or to contract in width and to raise or lower, thereby giving two dimensional geometrical adjustments. A first layer of product is loaded into the X-Y tray. Then the tray is lowered and a second layer is placed over the first layer. The process is repeated for any number of layers. Thereafter, the stack of layers is pushed into a carton.

11 Claims, 20 Drawing Sheets

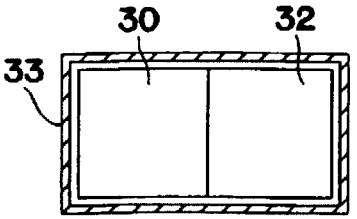
FIG. IA
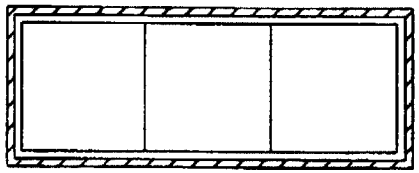
FIG. IC
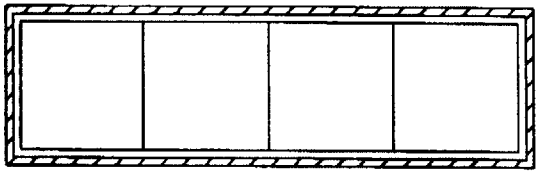
FIG. IE
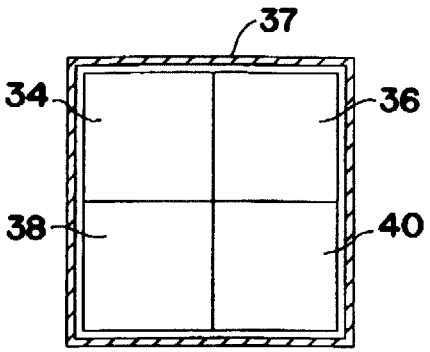
FIG. IB
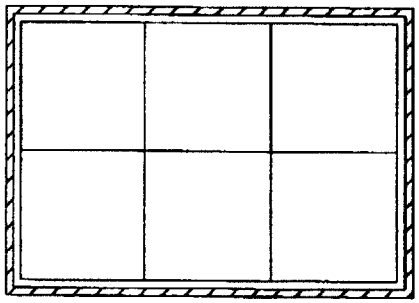
FIG. ID
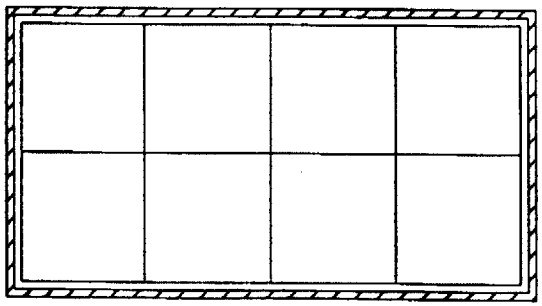
FIG. IF

HORIZONTAL CARTONER WITH VERTICALLY ARTICULATING PRODUCT TRAYS FOR MULTIPLE COUNTS/LAYERS OF WRAPPED PRODUCTS

This application is a continuation of application Ser. No. 08/293,732 filed Aug. 19, 1994 now abandoned, which is a continuation-in-part of application Ser. No. 08/169,374 now U.S. Pat. No. 5,560,184, filed Dec. 17, 1993.

This invention relates to automatic packaging machines and more particularly to machines for inserting layers of product into cartons.

BACKGROUND OF THE INVENTION

In the art of automatically packaging products for shipment to the market place, some products are placed in cartons in layers. Depending upon the product there may be any suitable number of layers. For example, thin candy bars may be packaged in many layers. Thick food products (such as tubes of soda crackers, shredded wheat, or the like) may be packaged in, say, two layers. Other items may be packaged in any suitable number of layers. Some products may have very smooth and uniform contours so that they easily slide over each other. Other products may have relatively rough surfaces so that they may snag each other if they try to slide over each other while confined in a relatively snug environment of a carton.

In the automatic packaging field, the term "slug" or "slugs" is sometimes used to generically refer to an individual item or items which are sorted, transported and otherwise handled in order to assemble and package them. Some "slugs" are more fragile than others and, therefore, must be handled with great care.

The invention may be used to package any "slugs"; however, for convenience of description, a tube of soda crackers wrapped in wax paper is described herein as an example of such a fragile slug. It should be understood that this reference to soda crackers is made merely to describe a product that is difficult to handle. The disclosure applies equally well to any suitable product.

Usually, the individual soda crackers are not perfectly aligned so that a few may stick out here and there as compared to the average position of most of the crackers in the tube. Therefore, as two side-by-side tubes of crackers are inserted into a box, they often scrape against each other. This and various other events tend to abrade the poorly aligned individual crackers. As a result, little pieces are broken off the crackers so that when the tube is opened, crumbs are likely to fall out and to be scattered, causing an annoyance to the consumer.

These crackers packed in wax paper tubes also illustrate another problem since the same kinds of tubes of crackers may be packaged in boxes of different size and shapes. Thus, for example, a small box may contain two and a large box may contain eight tubes of crackers. Some boxes may have all tubes arranged in a single layer. Other boxes may have the tubes arranged in two layers. As a second layer is inserted into the box, over a previously installed lower layer, there may be more chipping and abrading of the crackers.

Another a concern in an automatic packaging machine always, is the speed at which products are packaged. Therefore, all of the foregoing problems should be overcome while enabling the packaging machine to operate at still higher speeds.

SUMMARY OF THE INVENTION

Accordingly, an object of the invention is to provide new and improved automatic packaging machines, especially machines for metering and delivering product or "slugs" (such as tubes of soda crackers) which may be damaged by normal handling. In this connection, an object is to provide means for selecting any suitable number of slugs for loading into a box or other container. Here, an object is to load the slugs in any of many optional configurations.

A more specific object of the invention is to load boxes with tubes of soda crackers wrapped in wax paper or the like. Here, an object is to optionally load such tubes of crackers into selected boxes which may receive any number from two to eight tubes of crackers. In particularly, an object is to optionally fill boxes with tubes of crackers arranged in either one or two layers.

Another object is to provide a tray for carrying product through an automatic packaging machine which is adapted to receive layers of product in a plurality of different configurations. Here an object is to provide such trays which are adjustable in two dimensions to receive products layered in a variety of configurations which vary in both horizontal and vertical directions (here called "X-Y trays").

In keeping with an aspect of the invention, these and other objects are accomplished by a series of conveyor belts which run at progressively slower speeds in order to accumulate the slugs into a compact array with a desired product population density. A meter wheel after the end of the slowest conveyor belt picks up the slugs one at a time and deposits them on another and metering conveyor belt having fences periodically positioned thereon. The meter wheel lays a selected number of products or slugs on the other metering conveyor belt in a first area between each two adjacent fences. A counter causes the belt to move on and present a second and new fenced area after a selected number of slugs has been laid on the first area. This process is programmable so that any selected number of slugs are laid down on each of the areas.

An X-Y tray has an elevator plate flanked by two side plates, which are joined by comb-like structures having teeth which mesh or interdigitate to provide both width and height adjustments. This way a first layer of product having a suitable width may be placed on the elevator plate and then the elevator plate may be lowered to receive another layer of product which is deposited over the first layer. The process may be repeated any suitable number of times to receive any suitable number of products.

BRIEF DESCRIPTION OF THE DRAWINGS

A preferred embodiment is shown in the attached drawings, in which:

FIGS. 1A–1F show six optional configurations, by way of example, which may be selected for packaging the slugs in any of a number of cartons or boxes;

DETAILED DESCRIPTION OF THE INVENTION

Figure 2:
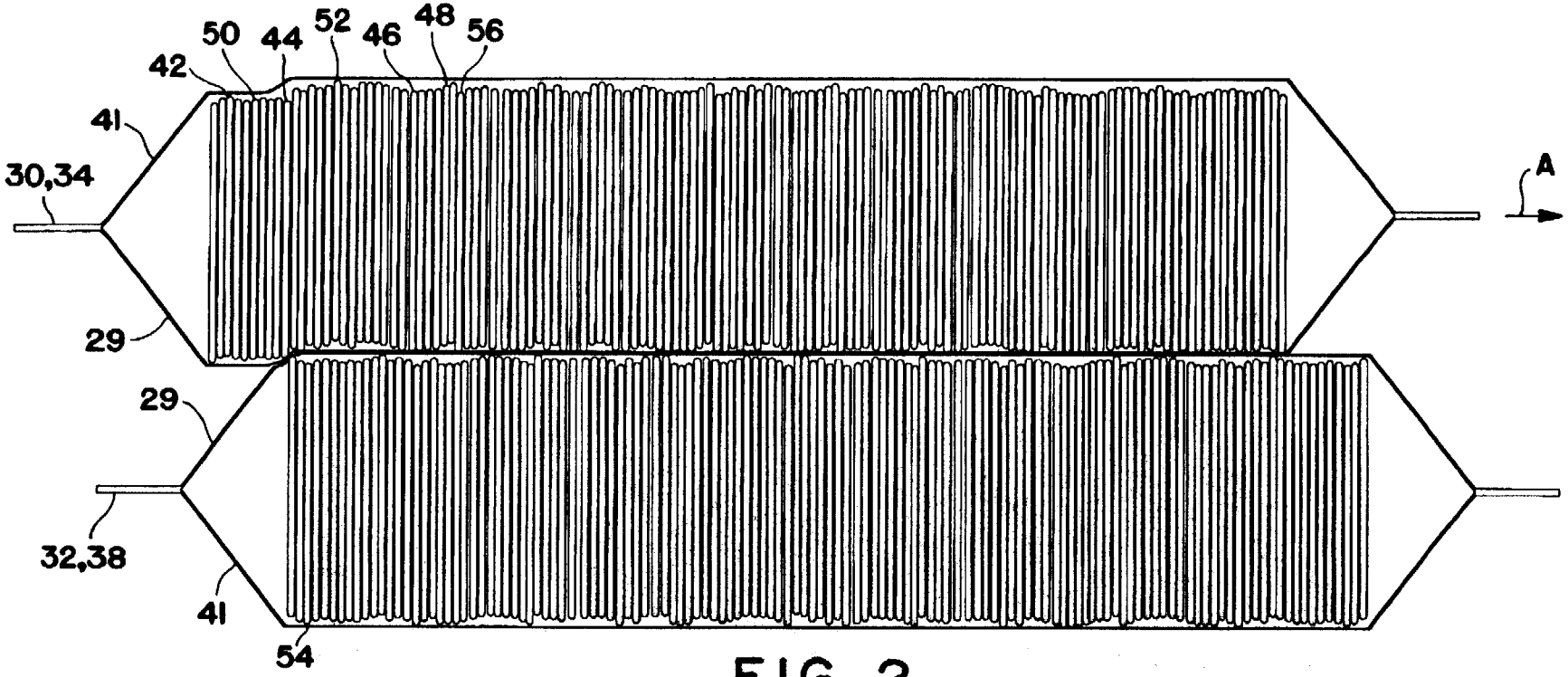
FIG. 2 illustrates how two slugs, such as tubes of crackers, may abrade each other as they are inserted into a box.

FIGS. 1A–1F show six optional configurations of exemplary boxes that may be loaded by the inventive slug packaging system. By way of example, this figure shows six different configurations in which tubes of soda crackers may be packaged in a selected one of several size of boxes. However, it should be understood that the principles described in these figures may be expanded to cover packaging "any suitable" number of slugs in a box.

More particularly, as shown in FIG. 1A, two tubes of crackers 30, 32 are positioned side by side in a single layer within a box 33. In FIG. 1B, the box 37 is twice as high as the box in FIG. 1A so that a second layer of tubes of crackers 34, 36 may be placed over the first layer 38, 40. Likewise, FIGS. 1C and 1E show that the single layer boxes may contain three or four tubes of crackers, respectively. FIGS. 1D and 1F show that by adding a second layer, the boxes may accept six or eight tubes of crackers. Therefore the slug feeder should be able to deliver a selected number of slugs, ranging from two to eight, to a single box of a selected one of many optional sizes.

FIG. 2 illustrates the problem faced by a feeder of relatively delicate products such as a tube of soda crackers wrapped in wax paper 29. As here shown, there may be two tubes 30, 32 which are inserted side by side in a single layer, such as in FIG. 1A. Or, the two tubes 34, 38 may be vertically stacked, as shown in FIG. 1B, where tube 34 is in an upper layer which is over tube 38 which is in a lower layer.

In FIG. 2, most of the crackers are fairly well aligned. For example, the crackers 42, 44 46 and 48 are in well aligned average positions. However, cracker 50 is displaced in one direction and cracker 52 in an opposite direction relative to the average placed cracker position. As a result, if tube 34 is being pushed in direction A in order to place it next to tube 38, the raised cracker 54 in one layer collides with the lowered cracker 56 in another layer of cracker tubes. This collision knocks flakes off the colliding crackers and causes crumbs and debris which fall out of the tubes, when opened, to the annoyance of the consumer.

Figure 3:
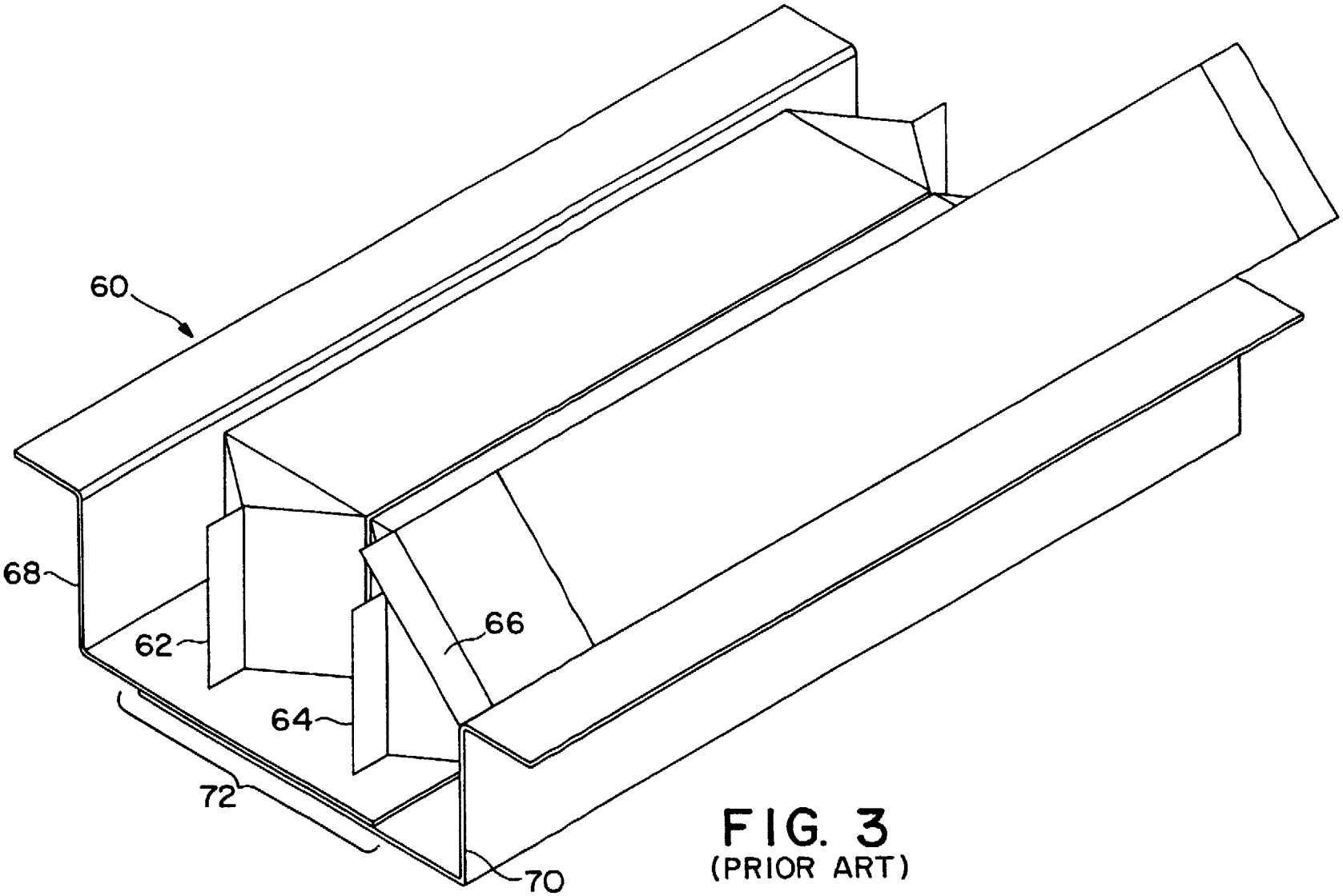
FIG. 3 (PRIOR ART)
FIG. 3 (taken from U.S. Pat. No. 5,072,573) shows how the irregular shape of the products may make it difficult to align them.
Figure 4:
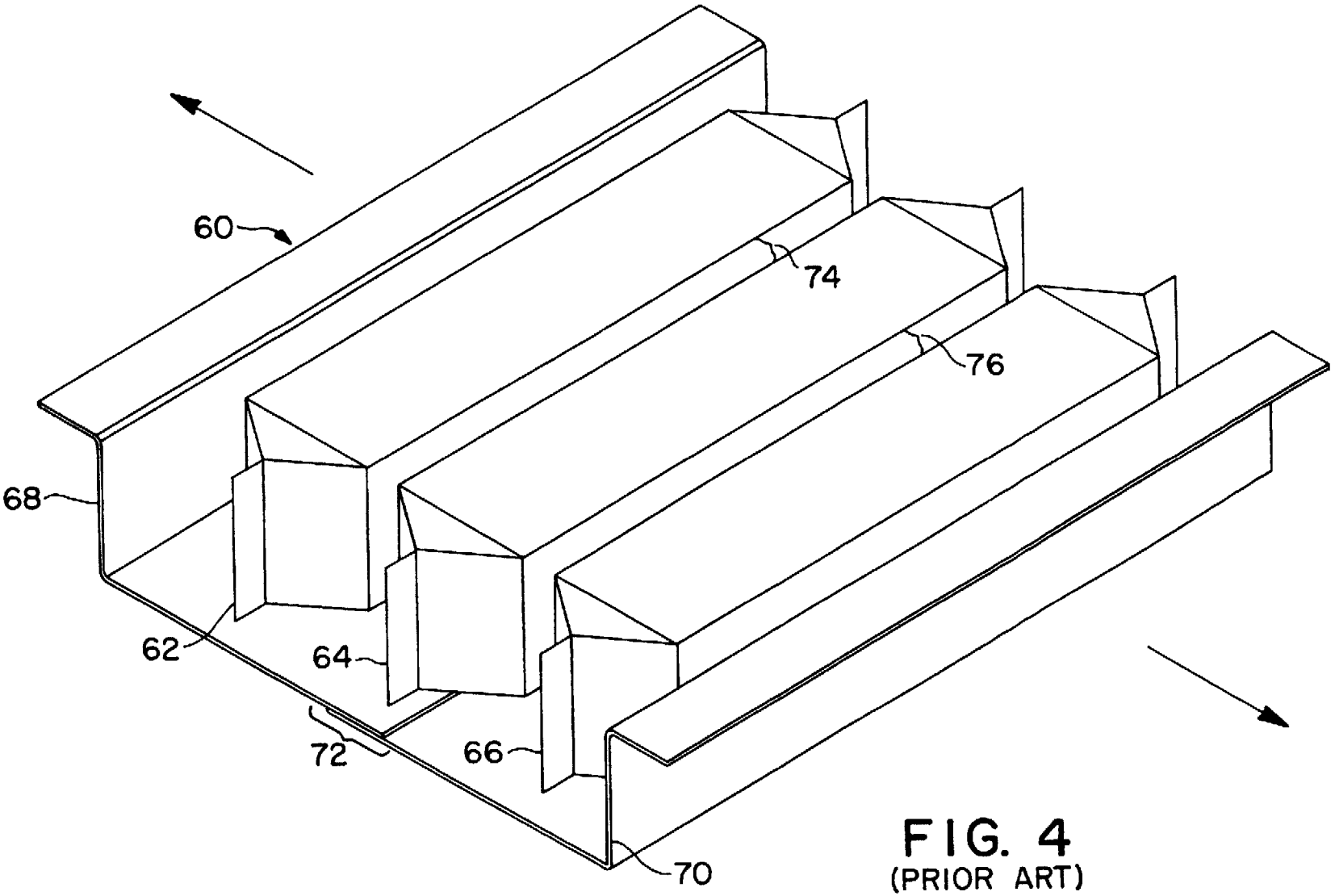
FIG. 4 (PRIOR ART)
FIG. 4 (also taken from U.S. Pat. No. 5,072,573) illustrates how, for the invention, the irregularly shaped product of FIG. 3 may be accommodated to form a single layer without abrasion.
Figures 5A, 6:
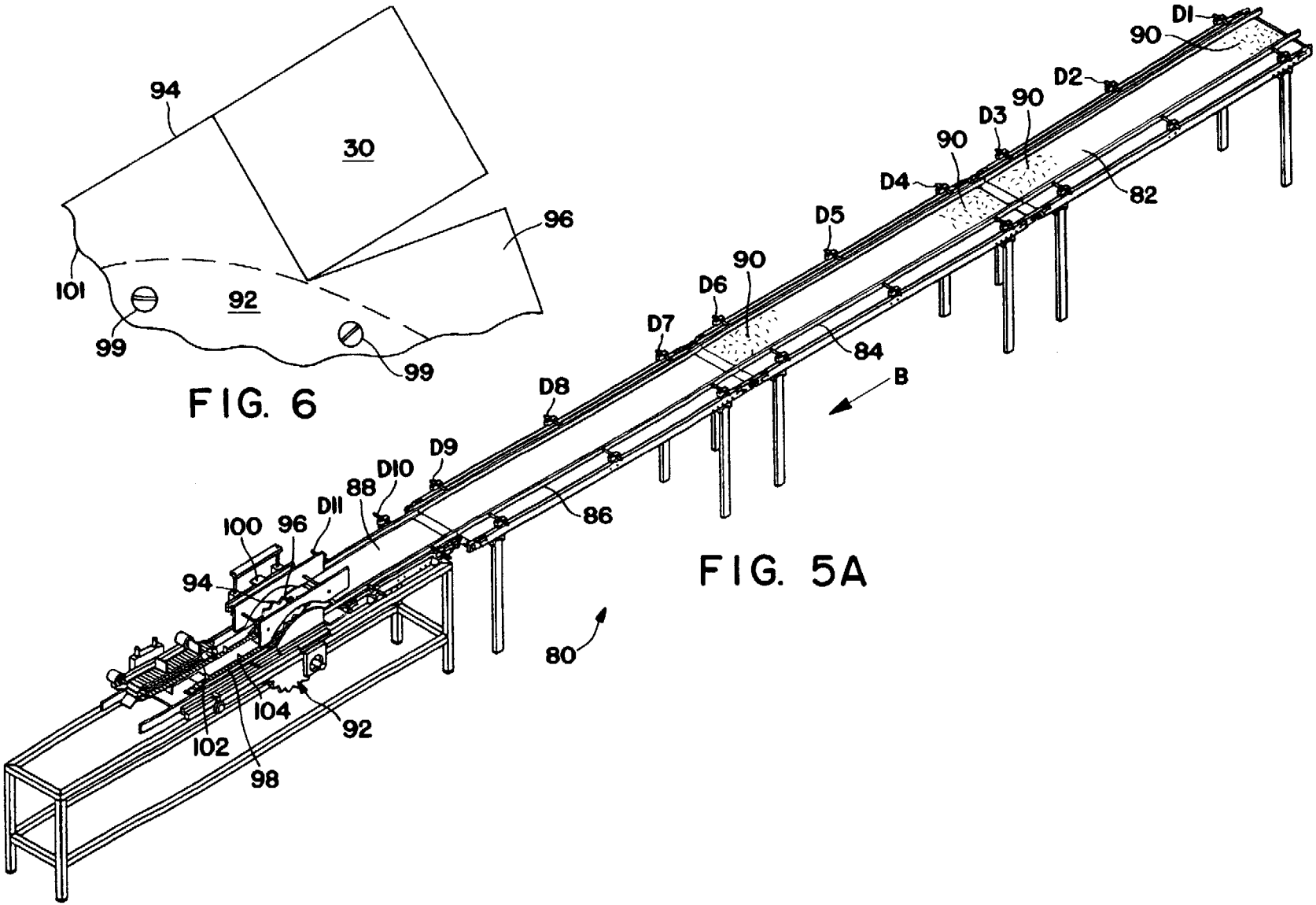
FIGS. 5A and 5B show an inventive slug feeder which incorporates the principles of the invention.
FIG. 6 is an enlarged view of a single space on the meter wheel for receiving a slug.

As shown in FIGS. 3, 4, the problems related to a horizontal insertion of tubes 30, 32 in a single layer may be solved by a variable width mandrel also shown in FIGS. 5, 6 of U.S. Pat. No. 5,072,573. This patent may be consulted for details on the construction of the mandrel and the control over the width thereof.

The product in the mandrel tray 60 includes three individually wrapped tubes 62, 64, 66 of soda crackers. Owing to the nature of the product, the three tubes do not have a closely controlled cross-section as shown in FIG. 2. The crackers may be misaligned so that each tube is, for example, an eighth of an inch wider than it should be, thus making an accumulated three-eights of an inch of excess width. Also, depending upon where the misaligned crackers are located, there might be a much greater than normal width. The sides of the tubes may be rather irregular so that the same three tubes would not always fit together in the same way. As shown in FIG. 3, the tube of crackers 66 does not fit down and into tray 68, 70.

It will be observed that, in FIG. 3, there is a substantial overlap 72 of the mandrel tray bottoms, which means that the tray is narrow so that the three tubes 62, 64, 66, of crackers must fit almost perfectly if they are to rest in side by side positions. In FIG. 4, the tray 20 has been made much wider (note the small overlap at 72) . Thus, there is enough space to receive the tubes of crackers in a side by side relationship with a substantial space 74, 76 between them. As the tray moves from a loading position to a packaging position, the sides 68, 70 may move together to take up the space 74, 76 and make the tubes fit into a box as the tray 60 becomes more narrow.

When the tubes of crackers are stacked vertically, as in FIGS. 1B, 1D, 1F, the first layer (e.g. 38, 40) is installed and then a blade is inserted into a mandrel or box and over that installed layer. Next, the second layer 34, 36 of crackers is pushed over the blade and into the mandrel or box. This way, the two layers of crackers do not come into contact with each other during the insertion of the second. After both layers are installed in the mandrel or box, the blade is withdrawn and the box is sealed. While the invention is here described in terms of upper and lower levels separated by a horizontal blade, it should be understood that other orientations could be used, such as side-by-side columns with a vertical blade separation.

Figure 5B:
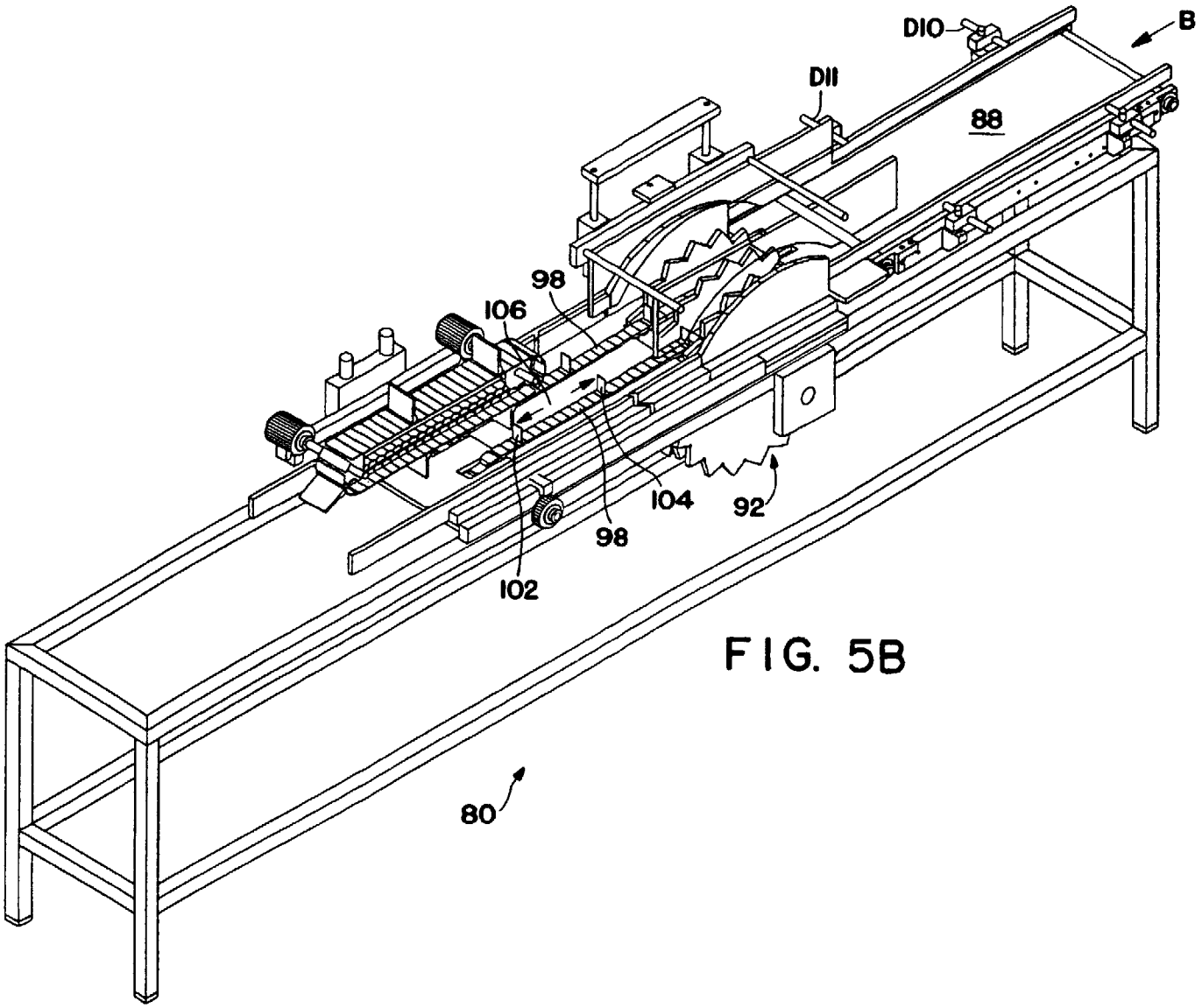

A slug loader 80 incorporating the foregoing principles is shown in FIGS. 5A, 5B, which are substantially the same except for the relative sizes of the parts. This loader is a servo infeed system which is a programmable product handling interface between an upstream supply machine and a downstream packaging machines. The object of this FIG. 5 machine is to assemble incoming product into batches to fulfil packaging machine infeed requirements.

An automatic packaging machine is located on the left hand end (as viewed in the FIG. 5A showing of the slug feeder). A bulk source of product is located on the right hand end of FIG. 5A. The purpose of the loader of FIGS. 5A, 5B is to pick up products from the bulk source (not shown) on the right and to transport them in direction B, delivering them in counted batches to the mandrel of FIGS. 3, 4. The software driven, computer based slug loader system has a programmable logic controller 77 (FIG. 7) connected to servo motor controller 78 which is capable of satisfying many different infeed requirements of a packaging machine. An encoder 79 is a remote sensing device which is used to measure the movement of the output of the slug loader and the input section of the packaging machine. The encoder is used to make the loader insensitive to the variation of speed of the associated machines, which is far superior to other solutions involving attempts to simultaneously run various machines in a time synchronism. Also, the programming flexibility make this approach attractive for many applications.

Three separate conveyor belts 82, 84, 86 (FIG. 5A) are placed in a series so that the product flows from a source on the right to a packaging machine on the left. Each of these conveyor is preferably a relative wide rubber belt. The first conveyor belt 82 travels faster than the second conveyor belt 84, and it, in turn, travels faster than the third belt 86. This means that if the products are scattered on the first conveyor belt 82, they will be brought together in a more or less compact relationship with a desired product density by the time that they reach a stationary table 88. Thus, the tubes of soda crackers, for example, will be in virtually side by side contact with each other when they are pushed onto table 88.

Along the series of conveyors, a number of detectors D1–D11 detect the passage of the products and momentarily stop the conveyors (as required) if the products are not flowing smoothly. Preferably, each of the detectors is a combination of a light emitting diode and a photo electric cell. As the detectors find that a downstream conveyor is becoming congested, the conveyors stop bringing in new products in order to loosen the accumulating product density. Then, after the traffic jam clears, the upstream conveyors resume their operation.

Further, the surface texture 90 of the upstream conveyors 82, 84 tends to be a little rougher to more or less ensure movement of the product. The surface of the downstream conveyor 86 is smoother so that the conveyor belt may tend to slip under a relatively compact accumulation of product to assure the desired product density. The table 88 has a relatively smooth, almost friction free surface so that the product slides easily into a pick up position.

A metering wheel 92 is positioned to pick up the tubes of crackers one-by-one as they appear on the output end of the table 88. The metering wheel 92 includes two or more spaced parallel disks, each having peripheral "teeth" such as 94, 96 defining recesses or pick up areas which correspond to two sides of the cross section of a tube of crackers 30. Thus, as shown in FIG. 6, a tube of crackers 30 has been picked up in the space between teeth 94, 96 and is being carried to a metering belt 98 down stream of the wheel 92.

The invention contemplates a plurality of disk having different peripheral toothed contours. Thus, for example, teeth 94, 96 (FIG. 6) are separated by a distance appropriate for picking up tubes of soda crackers. If the product is something else with a different cross section, either new disks 92 or a different ring will be installed in the slug feeder. For example, in FIG. 6, two bolts 99 may be removed and a ring having teeth 94, 96 may be removed from disk 92. Another ring, with a different profile, is installed on disk 92 and bolts 99 are returned to hold it in position.

A photo cell or other suitable detector 100 detects the presence of the picked up tube of crackers. Therefore, a counter may accurately count the tubes of crackers delivered at the output of the meter wheel even if, for any reason, one or more of the tubes of crackers are missing from the metering wheel.

The metering belt 98 has a plurality of up standing fences 102, 104 mounted thereon to define a receiving area 106 (FIG. 5B) between them. Each batch of product is delivered into an area 106 between adjacent fences. Therefore, the motion of belt 98 may be adjusted to receive batches containing a selected number of products which are accumulated with any suitable count, per batch. Then, the metering belt moves on one step and presents the next succeeding area to receive the next batch of product. For example, if the box awaiting the crackers is configured as shown in FIGS. 1A, 1B, two tubes of crackers 108, 110 (FIG. 7) are deposited in the area 106 between fences 102, 104. If configured as shown in FIGS. 1C–1F, three or four tubes are deposited in each area between the fences on the meter belt 98.

The loader (FIG. 7) includes independent drive control motors 112, 114. Motor 112 is controlled by a variable frequency drive circuit 116 under the direction of the various sensors D1–D11 (FIGS. 5A, 5B) so that the loading operation may be closely controlled. Thus, a microprocessor may control all of the loading operations. The loading parameters may be set into the microprocessor, and then in drive circuit 116 while the loader continues in operation. For example, the automatic packaging machine may be initially set to put two tubes of crackers in area 106 in order to fill a box configured as in FIGS. 1A or 1B. Then, without stopping the loader, it may be reprogrammed to put three tubes in area 106 for the boxes of FIGS. 1C, 1D or four tubes for the boxes of FIGS. 1E, 1F.

Whenever the loader stops, it is always stopped at the same initial position. Likewise, the various detectors and circuits operating responsive thereto are always set to respond uniformly to either a leading or a trailing edge of the product. The stopping of the loader for a lack of product is always delayed until the arrival of a point in the delivery cycle where the lack of that product is material to the required delivery. All of these and similar programming rules are calculated to eliminate the need for re-initializing or coordinating the various machines when loading restarts.

Figure 7:
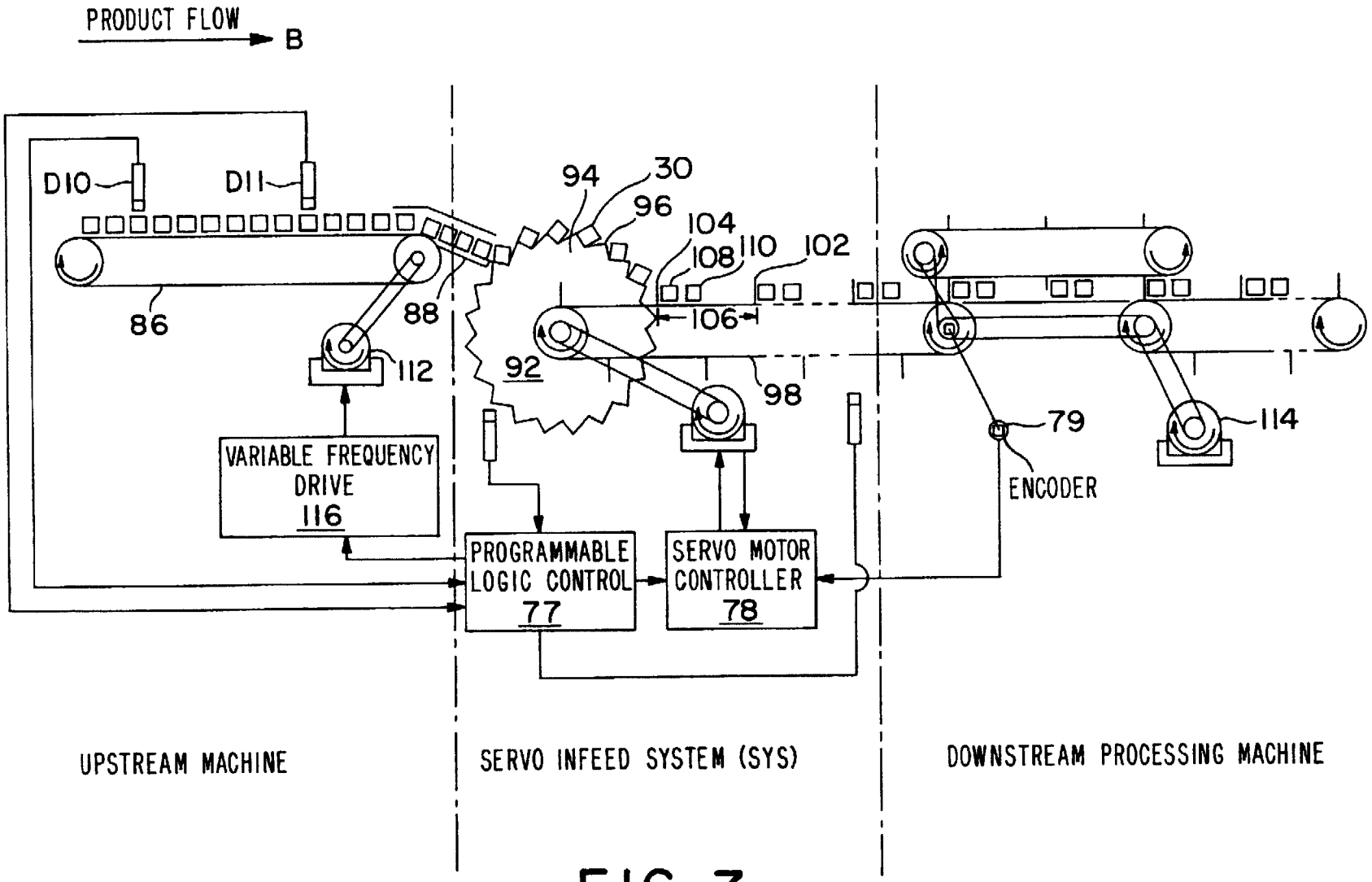
FIG. 7 is a schematic side elevation of a the slug feeder showing a flow of slugs through the machine of FIGS. 5A, 5B, 6.

In most cases, the programmable logic control circuit 77 (FIG. 7) is used to process all of the loader control inputs, especially in response to sensor signals. (While FIG. 7 shows only two sensors D10, D11, it should be understood that any number of sensors may be connected to controller 77.) Also, circuit 77 controls the various conveyors and delivers all control signals to the servo motor controller 78. Nevertheless, in some cases when rapid product handling is required, the scan time of circuit 77 could cause the accuracy of response time of the loader to deteriorate. In such a case, the outputs of position sensors D1–D11 may feed directly into servo motor controller 78.

The encoder 79 is responsible for coordinating and following an operational procedure according to the needs and speed of a downstream automatic packaging machine which is mechanically coupled to the loader with or without a gear box, depending on the application requirements.

Together the circuits 77, 78 perform a number of operations which control and coordinate the various parts of the system. Among other things these operations include an initial position adjustment of the product handling metering wheel 92, which uses all of the possible machine speeds as a reference; provide both "upstream" and "downstream" machine interaction (bi-directional handshaking); and start/stop (including emergency stop) handling with output signals. The control logic inside circuit 77 is programmed according to the requirements of associated upstream and downstream machines. Variable speed drives control motors 112, 114, accompanied with on/off control of the conveyers 82, 84, 86 in order to provide for a wide variety of packaging requirements. The in-fly parameter change facility may be programmed and reprogrammed according to the infeed process demands without stopping the machine.

Figure 8:
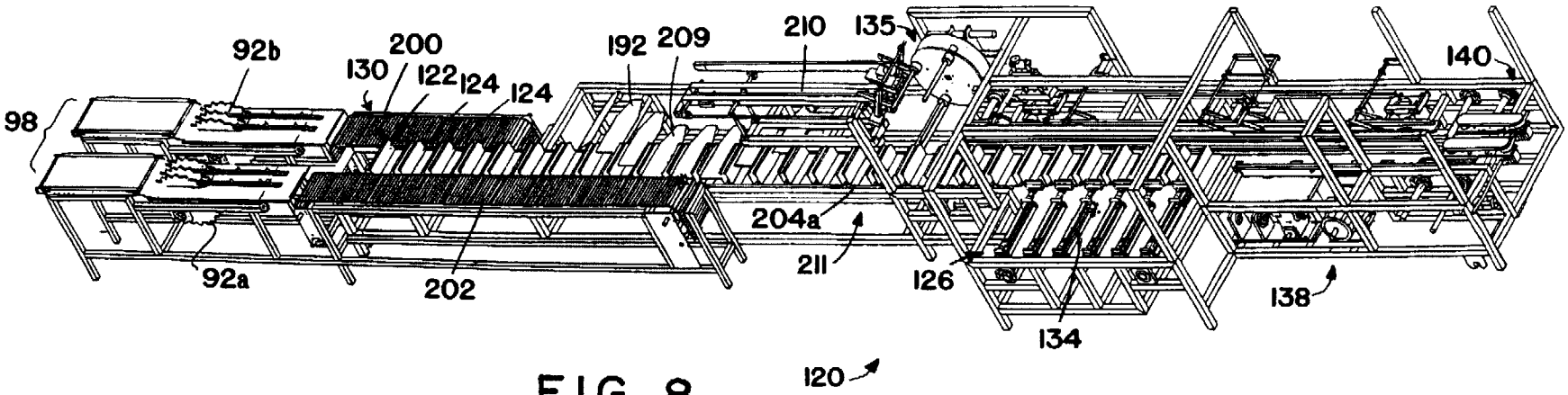
FIG. 8 is a perspective view of a first embodiment of an automatic packaging machine which may incorporate the present slug feeder invention.

FIG. 8 is a perspective view of a first embodiment of a packaging machine 120, of a type that may utilize the teachings of the present invention. One or two (here two) of the inventive loaders are located at 98 to feed product into the mandrels, each of which is the same as the mandrels of FIGS. 3, 4.

Figures 9, 9A:
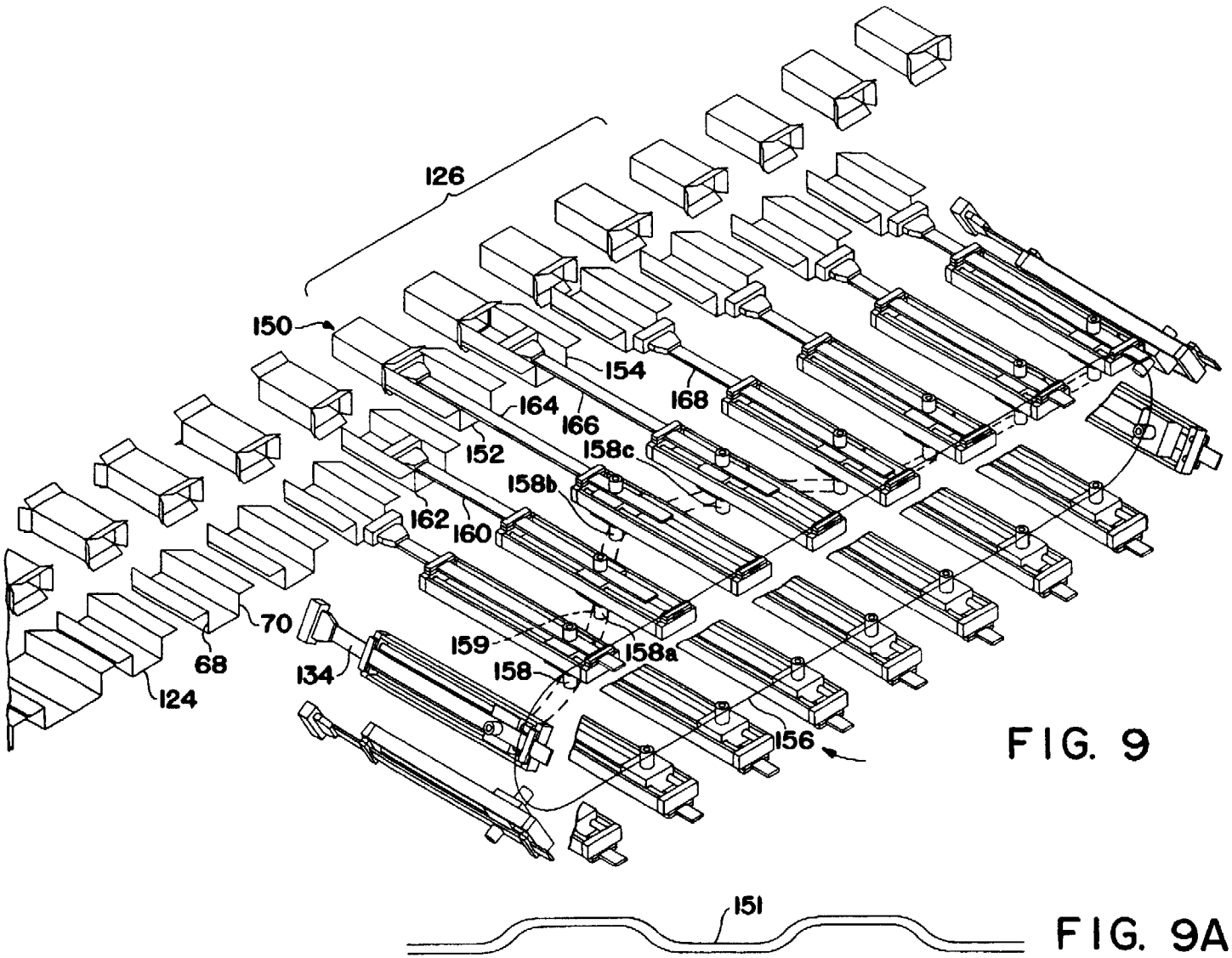
FIG. 9 (taken from U.S. Pat. No. 5,185,984) is a partly schematic, partly exploded view in perspective showing the operation of pushers for moving product from a forwardly thrusted mandrel and into the box and which also illustrates a general principle of how a loading blade may be thrust forward or retracted.
FIG. 9A shows a cam slot illustrating how the packaging machine may be programmed to perform different predetermined tasks.

The machine 120 includes an elongated conveyor 122 carrying adjustable width product mandrels 124 (FIGS. 3, 4) past a plurality of work stations, one having a thruster section 126 where the mandrels 124 may be thrust forwardly (as shown in FIG. 9) into a juxtaposed relationship with respect to confronting boxes 150. The conveyor 122 (FIG. 8) carries the mandrels 124 through a loader area 130 where they pick up products from a metering wheel 92*a*, or 92*b*. In this case, the product may be the tubes of crackers 30–40 (FIGS. 1A–1F) which are carried forward to the area 126 where the product is loaded into boxes. A pusher rod, such as 134, pushes the product from a forwardly thrust mandrel into a box.

The machine may also include any other work stations having suitable modules such as a carton or box feeder 135 (most of which is omitted in an interest of showing the underlying machine), a glue unit (not shown), a power drive units 138, discharge units 140, and miscellaneous system controls and adjustment means. A cam slot 151 (FIG. 9A) programs delivery by engaging each mandrel as it passes a loading station or thrust area and causes the mandrel to move outwardly toward the boxes (as shown it 152, 154) to a loading position.

FIG. 9 shows a plurality of mandrels 124 (also shown in FIGS. 3, 4) in various width dispositions. A product can be properly shaped and located by being conditioned by an inward movement (or by repeated cycles of inward and outward movements) of the upright sides 68, 70 as programmed by a cam slot (FIG. 9A), until the opposite sides are spaced apart by a distance which is complimentary to the lateral inside limits of the box. When properly positioned, the front end of this mandrel may be thrust forward and be fitted into and encompassed by the open end of the box, as show at 150 (FIG. 9).

Another conveyor 156 carries a number of pushers (such as 134), each having a cam follower 158 thereon. These cam followers ride in slot 159 extending parallel to a path followed by the mandrels 124. At a proper location relative to mandrels 124, the slot is inclined toward the box thereby moving a cam follower 158 to cause a pusher to move, as cam follower 158*a* is causing pusher 160 to enter the confronting mandrel 162 and to begin urging the product into the confronting box. At 164, the pusher has thrust the product completely into the confronting box 150 under the urging of cam follower 158*b*. At 166, the cam follower 158*c* is withdrawing the pusher from the confronting box. At 168, the pusher is completely withdrawn from the mandrel.

Figure 10B:
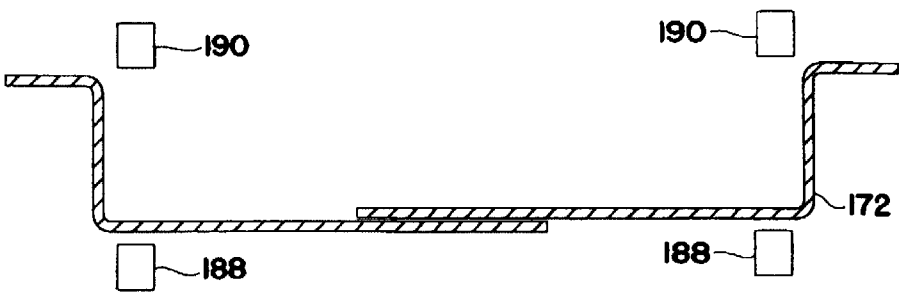
FIGS. 10–12 are three schematic, stop motion views showing how to the first embodiment loads two layers of product into a mandrel or a box without an abrasion of product.
Figure 10C:
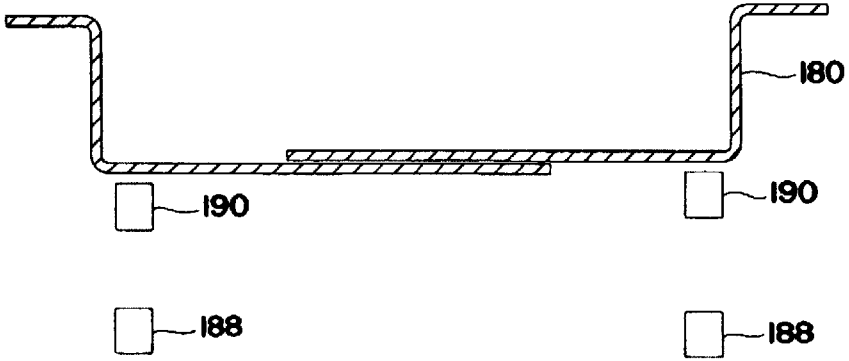
Figure 10A:
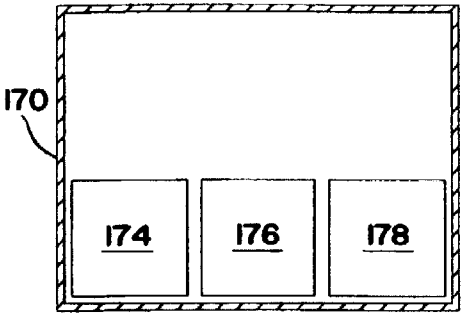
Figure 11:
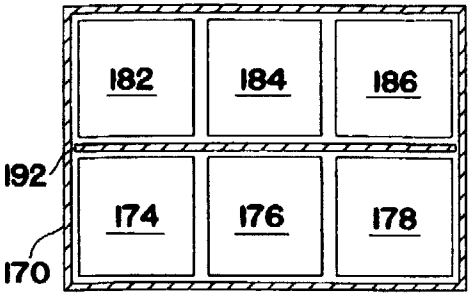
Figure 12:
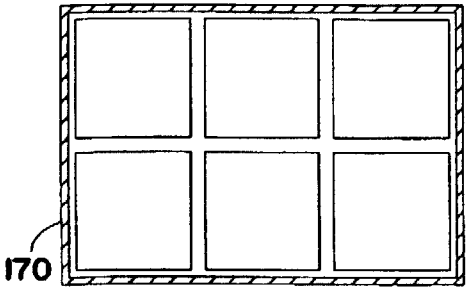

FIGS. 10–12 schematically show the principle of how two layers of product may be inserted into a single mandrel or a box 170 without abrasion of products in one layer against products in the other layer. This particular box 170 is drawn, by way of example, to illustrate the box also shown in FIG. 1D. However, it should be understood that a box of any suitable size may be loaded in the same manner.

In FIG. 10, schematically, the upper and lower conveyors 188, 190 are here shown above each other. The mandrel 172 which transports the lower layer of product 174, 176, 178 is schematically shown as at the level of the bottom interior of box 170. The mandrel 180 which transports the upper layer of product is schematically shown at the level of the upper layer of product 182, 184, 186. After the lower level of crackers is installed, the conveyor link chain might be designed to move from the lower level position of mandrel 172 to the upper level of mandrel 180.

However, in the preferred embodiment, two separate conveyor chains 188, 190 are provided with a lower conveyor chain 188 carrying the mandrel 172 and an upper conveyor 190 carrying the mandrel 180. The two conveyors may also be arranged in either parallel or series. Also, as will become more apparent, a preferred embodiment loads the two layers in a mandrel and then the stacked layers are pushed simultaneously into a box.

Figure 13:
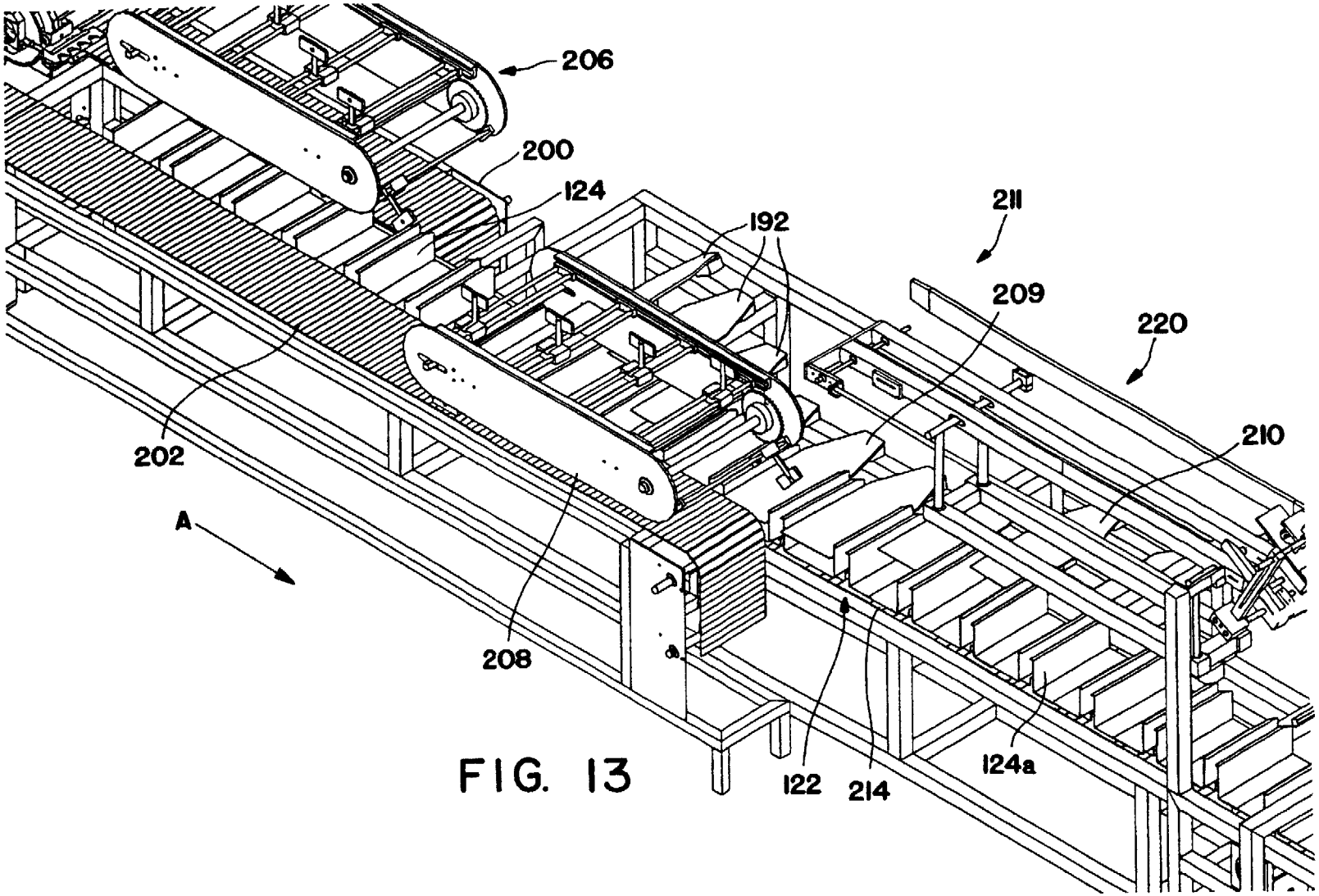
FIG. 13 shows an enlarged section of the machine of FIG. 8 where blades may be used according to the teaching of FIGS. 10–12 to protect a first layer of product while a second layer of product is being installed in a mandrel or box.

With these principles in mind, the actual machinery for accomplishing the loading will become more apparent from a study of FIGS. 8 and 13.

FIG. 13, which shows the preferred embodiment of the invention, is an enlarged portion of FIG. 8

One loader conveyor 200 is positioned at a level which is lower than the level of the other loader 202. Each loader conveyor has its own upstream metering wheel 92*a*, 92*b* (FIG. 8) and an associated input conveyor. A mandrel conveyor 122, carrying the mandrels 124, is located between the loader conveyors 200, 202. Two over head pusher units 206, 208 are located above individually associated one of the loader conveyors 200, 202. The pusher unit 206 associated with the lower loader conveyor 200, is located upstream of the pusher 208 associated with the higher loader conveyor 202.

The blade unit 211 has a plurality of thin metal blades (such as 209) connected to a blade conveyor 214. Each blade 212 has an attached cam follower which rides in a slot extending parallel to a path followed by the conveyor 214, similar to the showing of FIG. 9. At a proper location relative to the mandrels, the underlying slot is inclined toward the mandrel conveyor 122 thereby moving the cam follower and causing a blade to enter the confronting mandrel 124 and over the previously installed lower level of product so that two levels of product will not abrade each other when the upper level is slid over the lower level. At 220, the slot inclines away from the mandrel conveyor 122 and thereby moves the cam follower to withdraw the blade from the confronting mandrel.

The product on the lower loader 200 is pushed by the pusher unit 206 onto the confronting mandrel. As the mandrel moves along the mandrel conveyor 122 toward the upper pusher unit 208, blade unit 209 extends a horizontal into the mandrel tray and over the lower layer of product. When the mandrel reaches the position opposite the upper pusher unit 208, it pushes product into the mandrel tray on top of the blade which separates the two levels of stacked product. As the mandrel moves farther along the mandrel conveyor 122, the blade is withdrawn.

In operation, this machine is fed by two metering wheels 92a, 92b supplying two parallel positioned loader conveyors 200, 202 which are side by side. The loader conveyors 200 carries product at a lower level which becomes a layer of product in a lower level of a two level box (FIGS. 1B, 1D, 1F) or the only level, when there is but one level in the box (FIGS. 1A, 1C, 1E). The other conveyor 202 carries the product at the level which becomes the upper layer of product (FIGS. 1B, 1D, 1F). The two layers of product may be laid one on the other in the mandrel 204 and then both layers may be pushed simultaneously into one end of the box.

Hence, the mandrels 124 first receive the lower layer of crackers which are pushed from conveyor 200 by an overhead pusher system 208 (constructed as shown in FIG. 9). Then, farther down the line, another pusher system inserts the blades 192 (as at 209) over the lower layer of crackers in the mandrel 124. Next, the other and upper layer conveyor 202 inserts the upper layer of crackers into the mandrel 124 sliding over the blade 192. Finally, the conveyor withdraws the blade 192 (as at 210).

Thus, at the location 211, the loaded mandrel 124a (for example) is carrying two levels of product. When the loaded mandrel 124a reaches work station 126 (FIG. 8), the stacked products are pushed into the box by a pusher 134. This way, there is no abrading of product on one level which might otherwise be caused by the sliding of the product of one layer over the other layer.

In a second embodiment of the invention, slugs, such as the tubes of crackers are placed next to each other, or layers are stacked one upon each other in a mandrel or tray on the conveyor. Then, all of the products which are so positioned or stacked are pushed horizontally into the carton, as a unit. In order to accomplish this form of loading, the mandrel trays should be adjustable not only in width, but also in depth (an X-Y adjustable tray).

Figure 14:
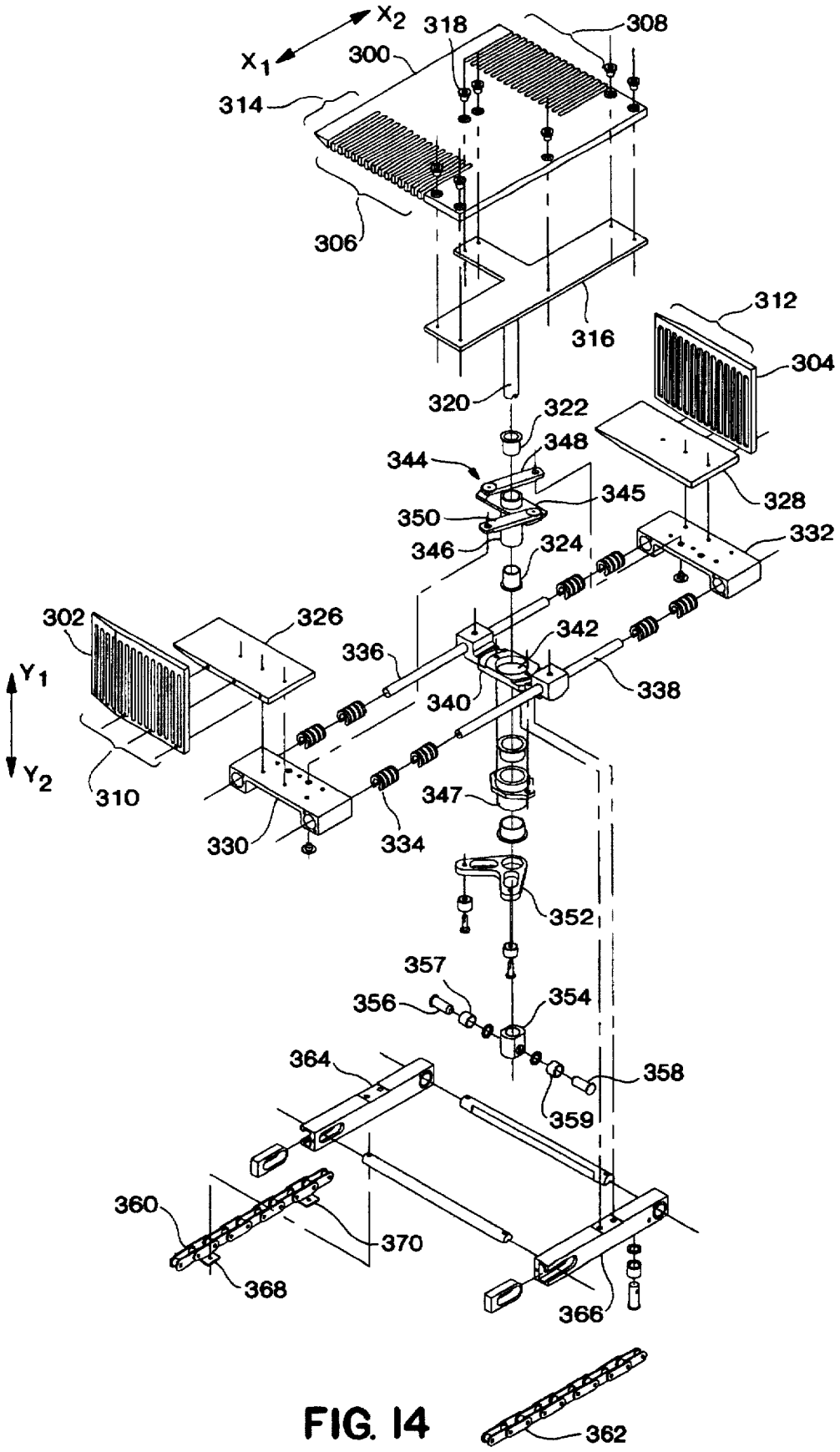
FIG. 14 is an exploded view of a second embodiment incorporating an X-Y tray.
Figure 14A:
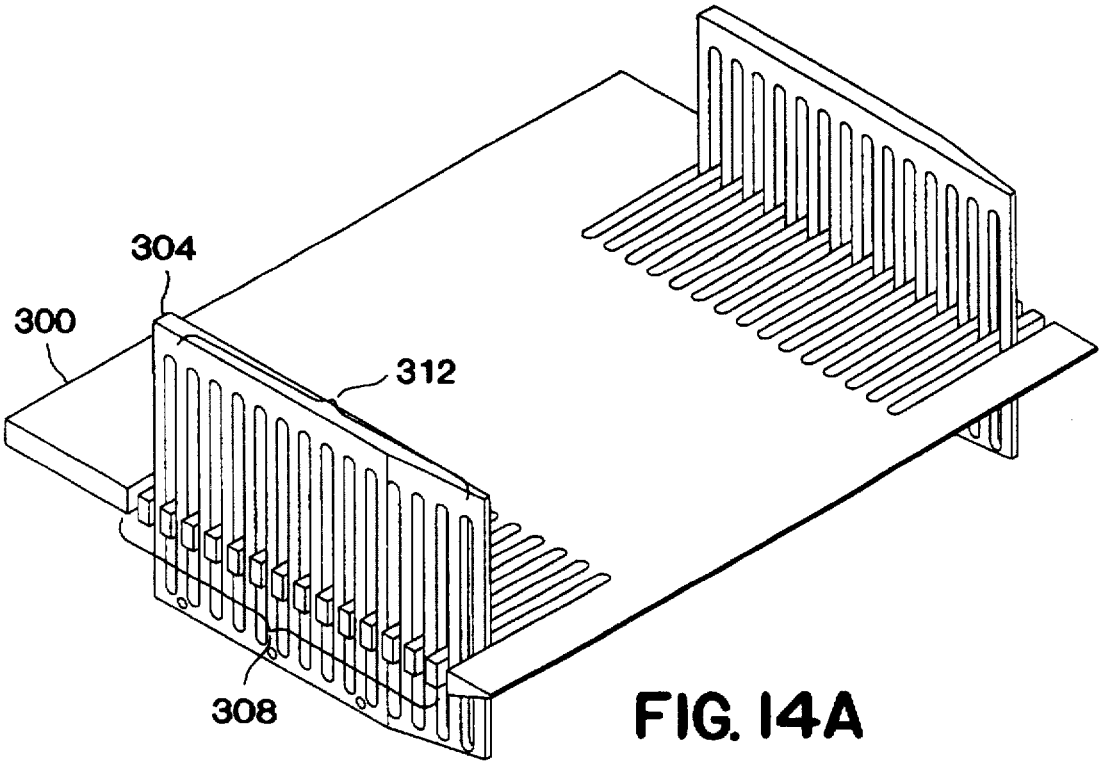
FIG. 14A show a fragment of an X-Y tray illustrating how the fingers or teeth of comb-like structures on an elevator plate and sidewalls interdigitate.

FIG. 14 shows an X-Y adjustable tray which comprises an elevator plate 300 and two side plates 302, 304, each of which has a comb like structure 306–312, wherein the comb teeth merge or interdigitate (see FIG. 14A). Hence, the two side plates 302, 304 may slide back and forth (directions $X_1$–$X_2$) within the span 314 permitted by the length of teeth 306, 308. Likewise, the elevator plate 300 may slide up and down (directions $Y_1$–$Y_2$) within the span permitted by the length of teeth 310, 312.

Hence, if the loading configuration is, for example, two side by side crackers tubes 30, 32 (FIG. 1A), the elevator plate 300 is positioned as high as it will go (direction $Y_1$) and the two side plates 302, 304 are closely positioned (directions $X_1$ and $X_2$). On the other hand, if the configuration is four cracker tubes in each of three layers, for example, the elevator plate 300 is positioned as low as possible (direction $Y_2$) and the side plates 302, 304 will be as far apart (directions $X_1$–$X_2$).

In between, the X-Y tray may be configured as may be needed. For example, the product packaging configuration of FIG. 1D makes the tray assume a position where both elevator plate 300 and side walls 302, 304 are more or less in a middle position. It should now be apparent how each of the six product configurations of FIG. 1 may be accommodated and how a third layer may be added. Of course, the same principle may be applied to other products. For example, thin candy bars may be stacked in, say, four or five layers. In a similar manner, by properly positioning plates 300–304 and by selecting the length of teeth 306–312, the principle may be expanded to cover any suitable product loading configuration.

The remaining elements in FIG. 14 are used to control the X-Y movements of the plates 300–304. In greater detail, the elevator plate 300 is attached in any suitable manner to a plate 316. For example, plates 300, 316 may be riveted or spot welded together, as at 318. Attached to and dependent from plate 316 is a support rod 320 which slides up and down in brushings or bearings 322, 324.

The side plates 302, 304 are attached to base plates 326, 328. These base plates are, in turn, attached to individually associated slide blocks 330, 332. Each slide block contains bearings, such as 334, which slide over associated ones of a spaced parallel pair of slide shafts 336, 338. Therefore, the side walls may easily slide back and forth in the directions $X_1$–$X_2$. The slide rails 336, 338 are supported by a central plate or cross brace member 340 having a sleeve 342 therein for slidingly receiving the support rod 320. Therefore, the slide rod 320 may easily slide up or down (directions $Y_1$–$Y_2$) through sleeve 342 in order to raise or lower the elevator plate 300.

Mounted to turn freely on the support rod 320 is a mechanism 344 for controlling the width of the X-Y tray. In greater detail, center plates 340 has a hollow central tube 342 with a bore which has a diameter large enough for rod 320 to slide freely there through. The bottom of tube 346 is rotatably supported in a brace member housing 347 attached to the underside of cross brace member 340. Therefore, mechanism 344 may turn independently of the vertical position of support rod 320. A central plate 345 is mounted on a tube 346 which rotates a pair of links 348, 350 connected to the slide blocks 330, 332. Therefore, if the mechanism 344 rotates clockwise, links 348, 350 push the slide blocks 330, 332 outwardly to increase the space between side plates 302, 304 (the width of the tray). Or, if mechanism 344 is rotated counter clockwise, the links 348, 350 pull side plates in order to decrease such space.

The mechanism 344 is rotated under the control of the pivot clamp 352 which may be turned by any suitable means such as a manual adjustment, a cam track, a microprocessor, or the like. To select between the configurations of FIG. 1, for a fairly extended run where conditions do not change, a manual or programmed adjustment is probably best.

Attached to the bottom of the elevator support rod 320 is a collar 354 with cam pins 356, 358 projecting therefrom for supporting cam rollers 357, 359. These cam rollers ride on cam tracks along the path followed by a conveyor to control the vertical height of the elevator plate 300.

In a third embodiment (FIG. 21), a cam track 361 receives cam rollers 357, 359 and, moves the elevator plate 300 to each of three levels $L_1$, $L_2$, $L_3$, as the tray travels along a conveyor with a different layer of product being deposited in the X-Y tray at each level.

A pair of conveyor chains 360, 362 are trained over sprocket wheels to provide an endless conveyor for carrying the X-Y tray around a closed path. A pair of tray support members 364, 366 are bolted to the conveyor chains, as by brackets 368, 370, for example.

Figure 15:
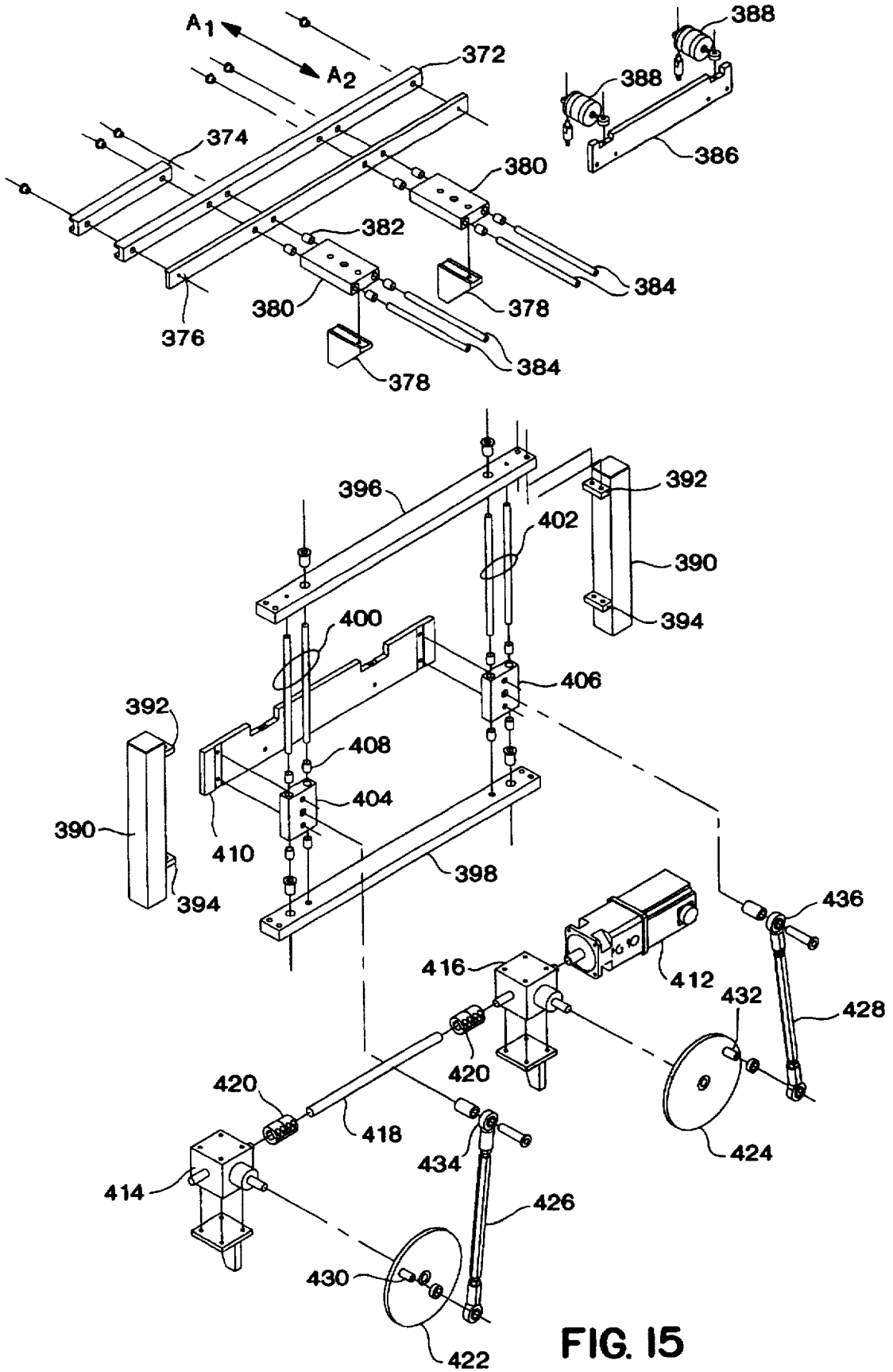
FIG. 15 is an exploded view of a mechanism for controlling width and height adjustments of the X-Y tray of FIG. 14.
Figure 21:
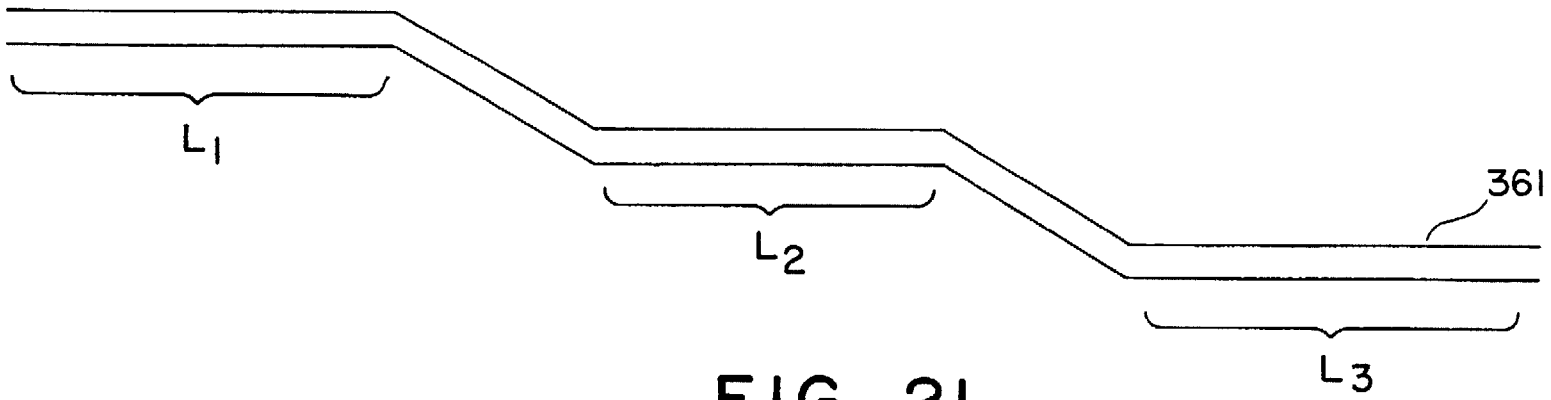
FIG. 21 is a showing of a cam track which may be used in a third embodiment of the invention.

A mechanism for controlling and operating the X-Y tray is seen in FIG. 15. Of course, there may be many different ways of controlling the X-Y tray; however, this one is here shown because it is used at a relatively compact loading station where the X-Y tray stops and the layers of product are stacked one over the other. The continuous cam track of FIG. 21 may also be used, but then the loading station is, say, three times as long as the loading station of FIG. 15. An advantage of the cam track of FIG. 21 is that the trays run continuously while the trays of FIG. 15 stop and start. Each embodiment has advantages for particular needs.

The metering wheel 92 of FIG. 7 may lay any selected number of tubes of crackers between the fences 102, 104 (FIG. 7). As here shown, the two tubes 108, 110 may correspond to the two tubes 30, 32 of FIG. 1A. If the carton is to be packed in the configuration of FIG. 1E, for example, four tubes of crackers are laid down between fences 104, 102. If the packaging configuration is as shown in FIG. 1F, the layer of crackers between fences 102, 104 are pushed off and onto the elevator plate 300 (FIG. 14). Then, the elevator plate is lowered by a vertical distance approximately equal to the height of the first layer of crackers. Next, crackers in the section of conveyor 98 next following section 106 (FIG. 7) is pushed over top of the first layer in the same tray. If there should be a third layer of crackers, the elevator plate 300 is again lowered and the third layer of crackers is pushed over the first two layers. In a like manner, any suitable number of layers may be accommodated.

The loading station (FIG. 15) contains an elevator control means which has at least one cam track 372 for receiving the cam rollers 357, 359 (FIG. 13). A second cam track 374 may or may not be provided in order to control for performance of any desired supplementary functions in the loading stations. The cam track or cam tracks are secured to a support member 376. Housing supports 378, 378 are secured to any suitable supporting structure (not shown). Bolted to the housing supports 378, 378 are two slide housings 380, 380 having bushings or bearings 382 mounted therein. A plurality of slide bars 384, mounted to slide in the bearings 382, are connected to the cam support 376. Therefore, if the slide rods move to the left or right (as viewed in FIG. 15), the cam tracks 372, 374 move to the left or right, respectively.

An air cylinder mounting plate 386 is supported in any suitable manner. A pair of air cylinders 388, 388 are mounted on air cylinder mounting plate 386 and are connected to move support rods 384. Therefore, the cam tracks may be slid back and forth in directions $A_1$–$A_2$ in order to coupled or uncoupled the cam track and the cam rollers 357, 359 (FIG. 14) responsive to a selective operation of air cylinders 388, 388.

Figure 16:
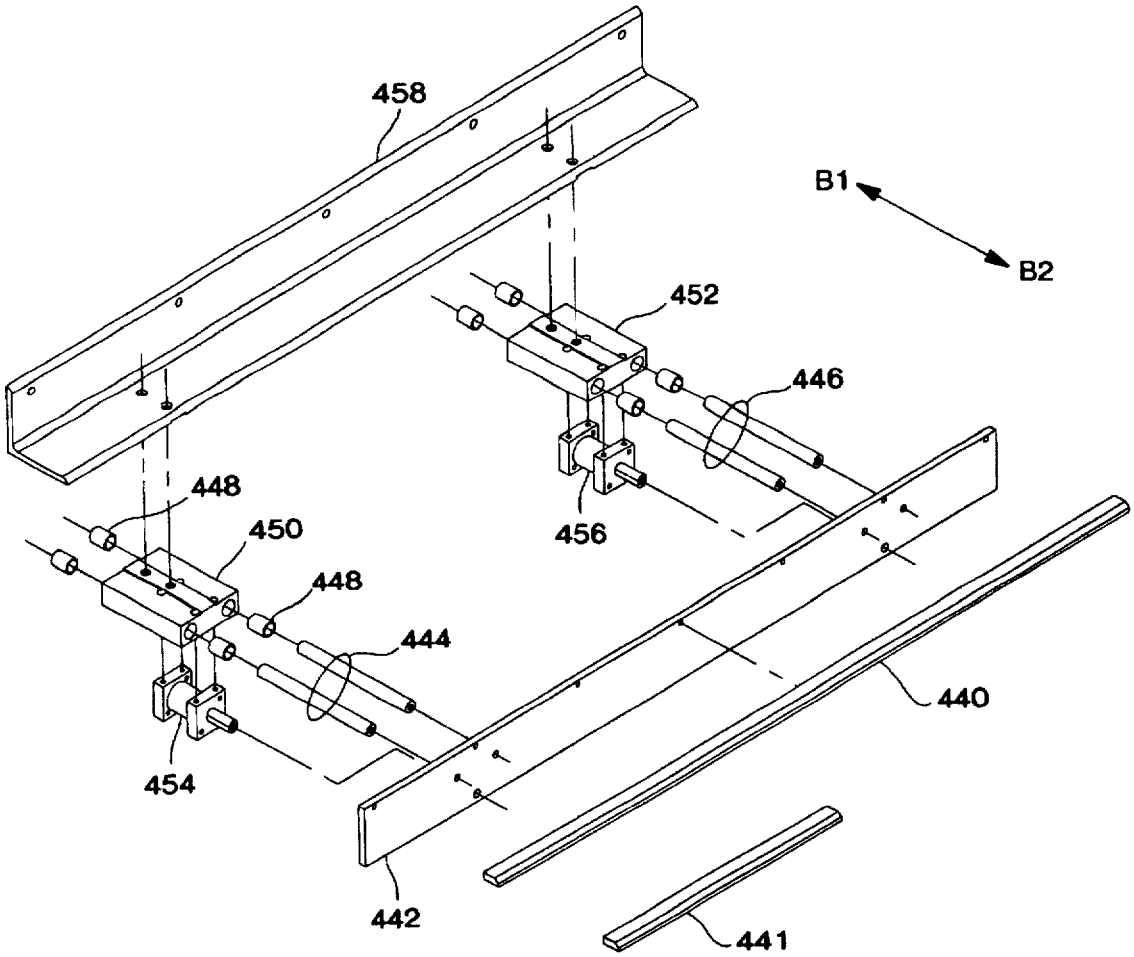
FIG. 16 is an exploded view which shows a skid for supporting the X-Y tray during an interim while the mechanism of FIGS. 14 and 15 are engaging each other.
Figure 17:
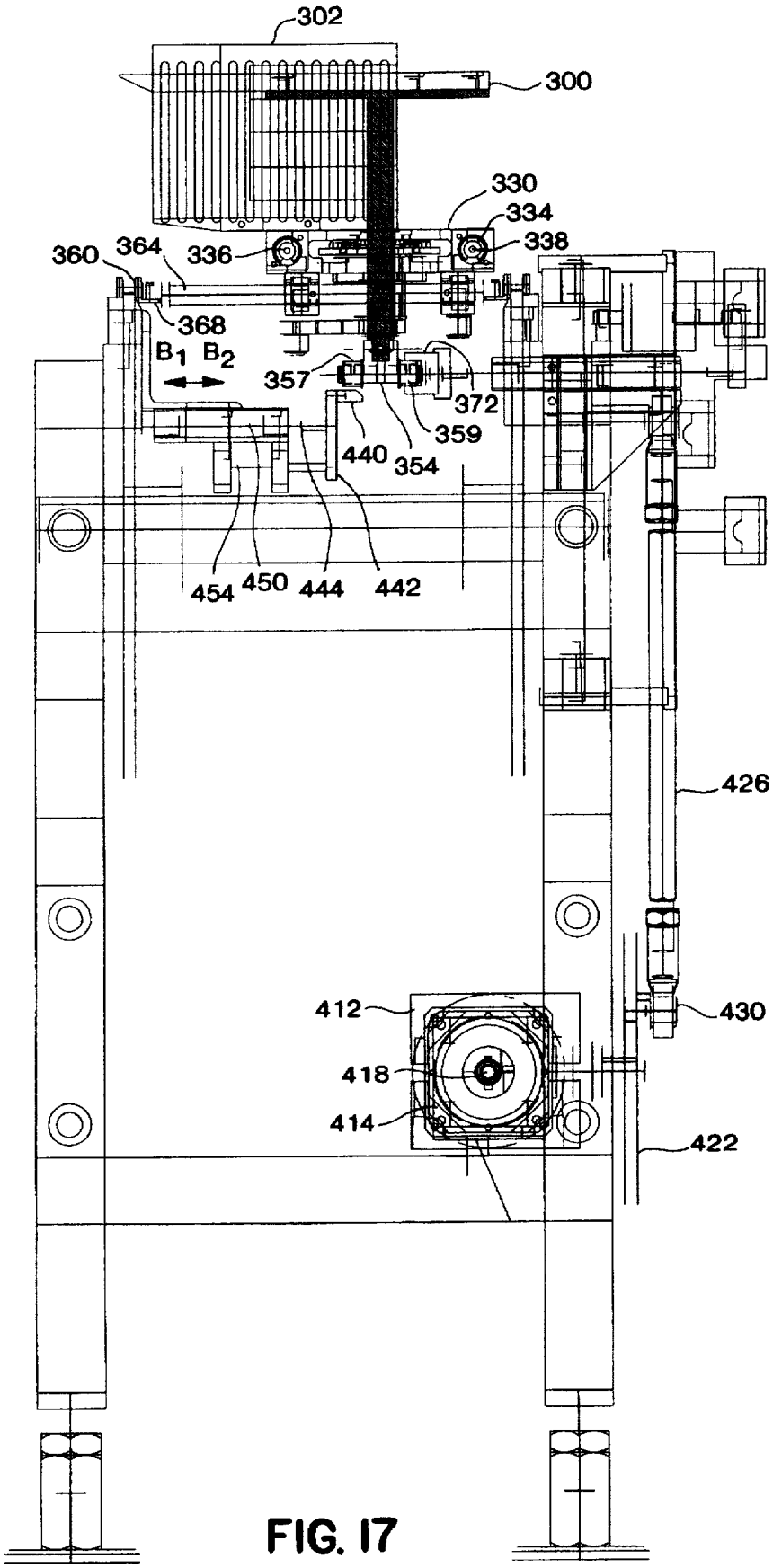
FIG. 17 is an end elevation view of the second embodiment.
Figure 18:
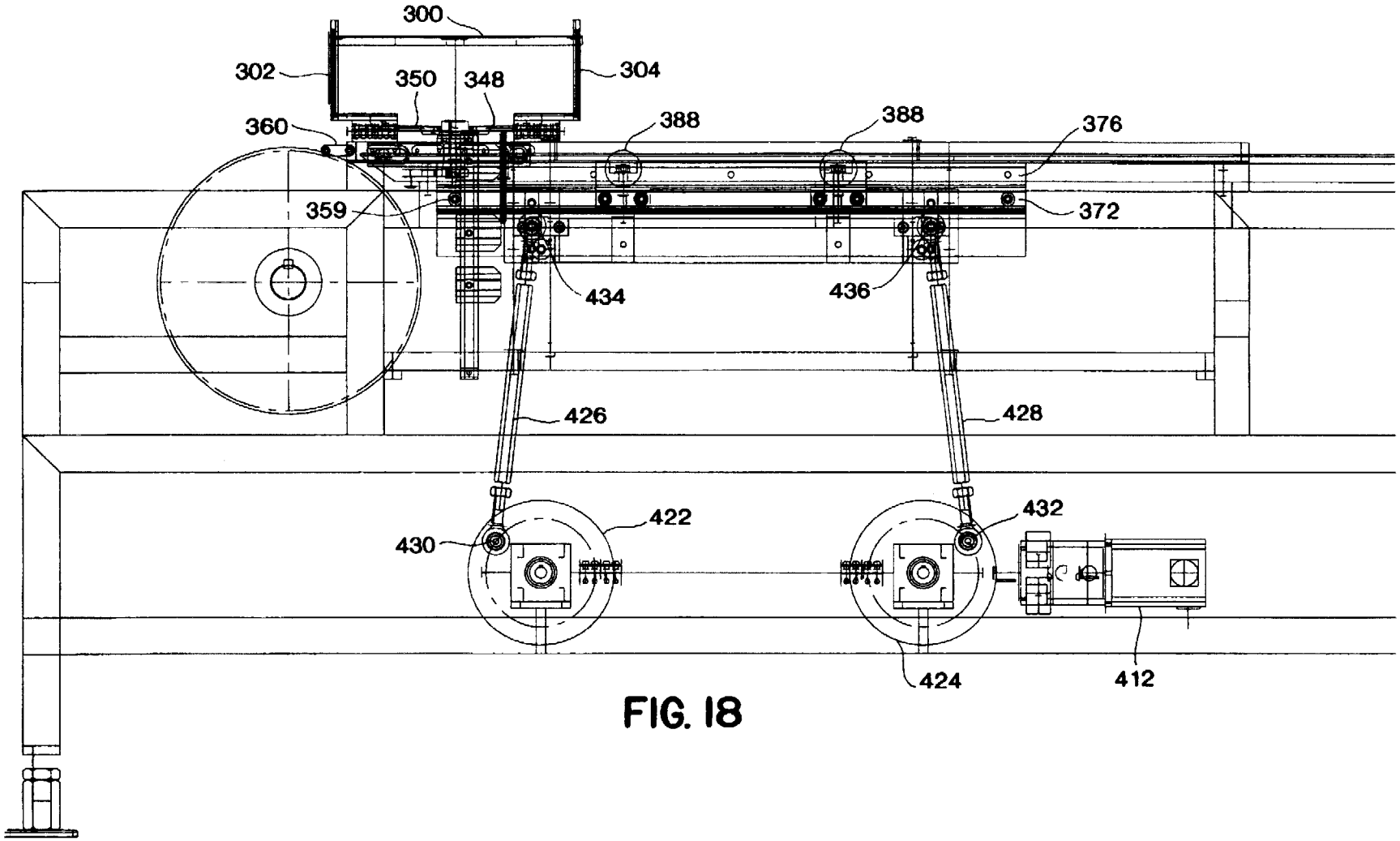
FIG. 18 is a side elevation view of the second embodiment.
Figure 19:
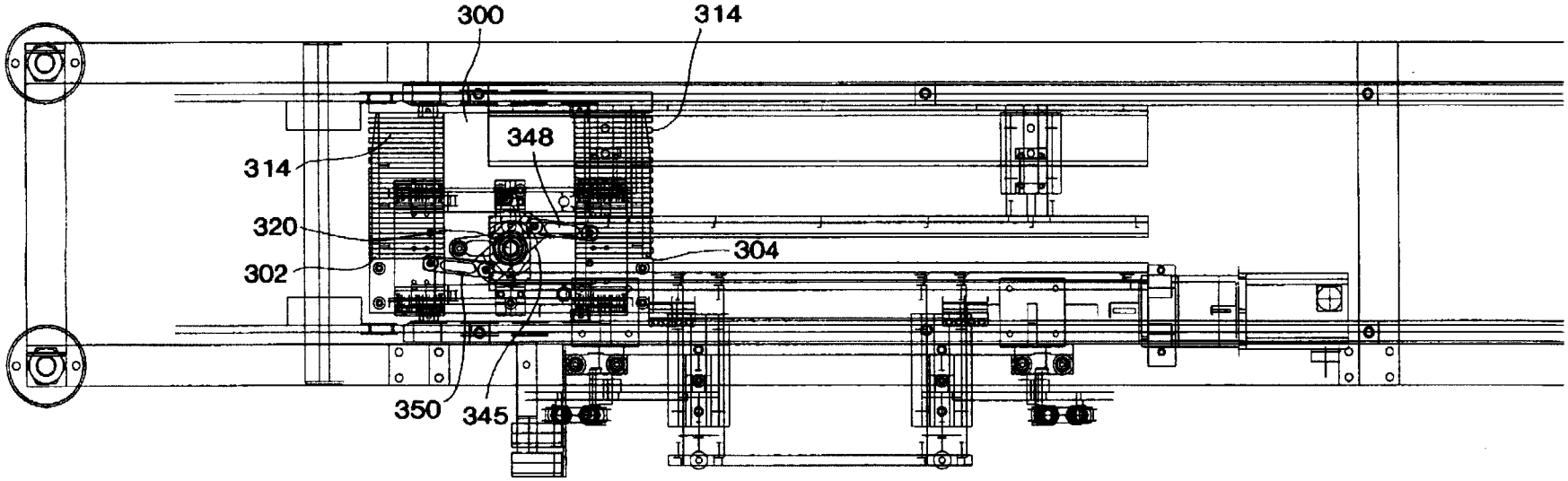
FIG. 19 is a top plan view of the second embodiment.
Figure 20:
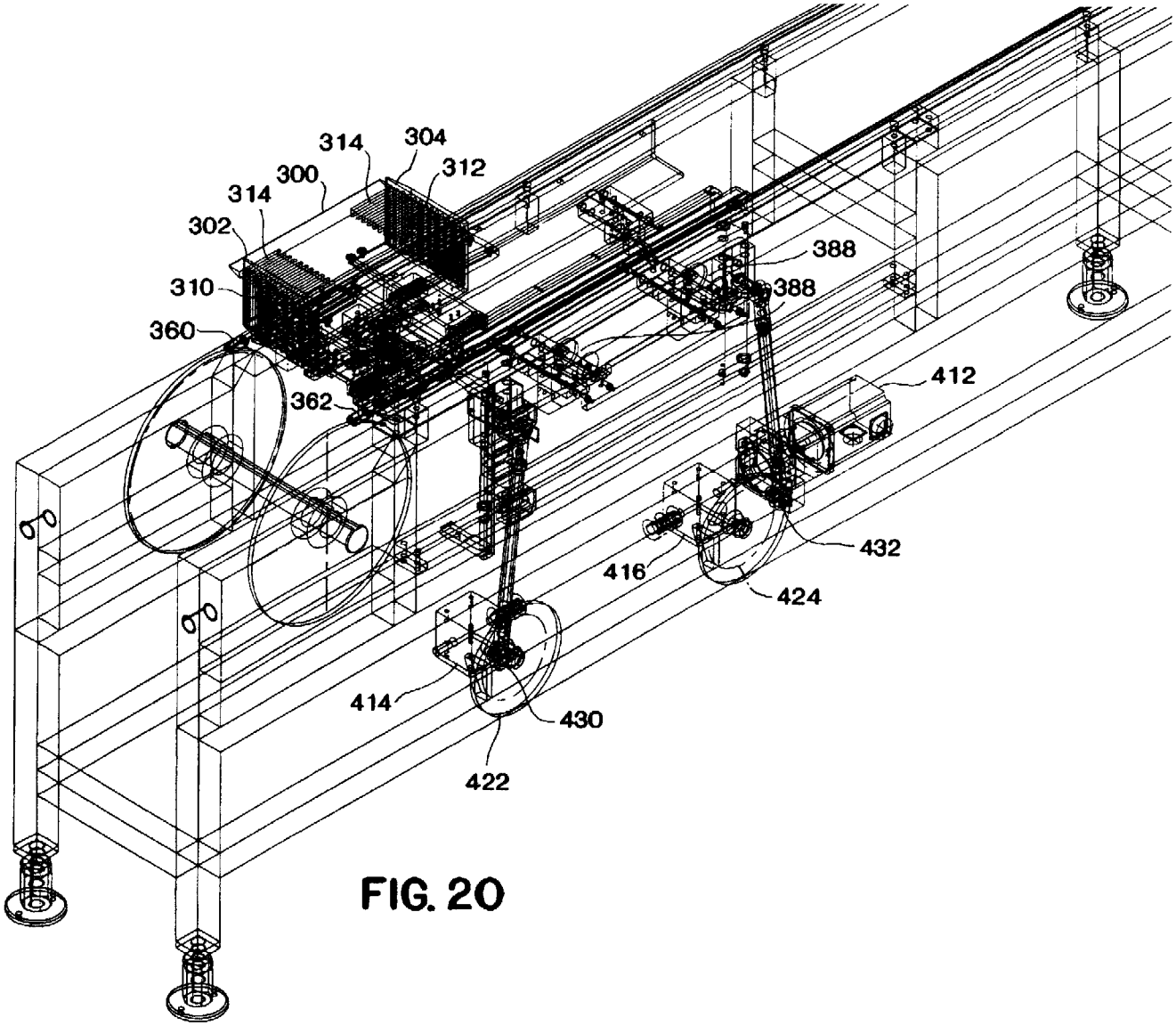
FIG. 20 is a perspective view of the second embodiment.

A skid support is seen in FIGS. 16, 17. When the X-Y tray comes into a loading station and stops, the cam roller 357 (FIG. 17) is positioned over a skid bar 440 which initially supports the elevator plate 300 in one of its positions (preferably the upper most position). If the short cam track 374 is used, the short skid bar 441 is also used. After the cam track 376 moves in to support the cam rollers 359, the skid bar is retracted.

In greater detail, skid bar 440 is attached to a skid support plate 442 in any suitable manner, as by bolts or welding. The support plate 442 is attached to skid slide shafts 444, 446 which slide in bearings or bushings (such as 448) in slide housings 450, 452. A pair of air cylinders 454, 456 are suspended from the slide housings 450, 452 and are connected to support plate 442 in order to move it in directions $B_1$, $B_2$. The entire assembly is supported by an angle iron main skid support member 458, which is part of the main frame or housing.

Hence, in operation, the X-Y tray comes into the loading station and stops with the elevator plate 300 supported by skid 440. Then, air cylinders 388, 388 (FIG. 15) move cam track 372 in direction $A_1$ and into contact with cam rollers 357, 359. Next air cylinders 450, 452 (FIG. 16) withdraw (direction $B_1$) the skid 440 since it is no longer required to support elevator plate 300. Thereafter, the cam rollers are completely in the control of track 372.

A mainframe of any suitable design is represented by members 390, 390. These members may be part of a large table made of angle iron or other structural forms. Upper and lower mounting means 392, 394 are attached or welded to each of the main frame members 390, 390. Upper and lower supports 396, 398 are attached to mounting means 392, 394.

Vertical slide bars 400, 402 are attached between the supports 396, 398. Two slide housings 404, 406 contain bushings or slide bearings 408 which are mounted on slide bars 400, 402. Connecting plate 410 is connected to slide housings 404, 406. Therefore, the connecting plate 410 may slide up or down to the extent permitted by the length of the slide bars 400, 402.

The air cylinder mounting plate 386 is attached to connector plate 410. Therefore, it should now be clear that conveyor chains 360, 362 (FIG. 14) may move the X-Y tray to the loading station and stop. Then air cylinders 388, 388 (FIG. 15) may move the cam track 372 in direction $A_1$ to capture cam rollers 359. Thereafter, the skid support 440 is moved out from under cam rollers 357 responsive to the urging of air cylinders 454, 456 (FIG. 16). Elevator plate 300 (FIG. 14) moves up or down as the connecting plate 410 (FIG. 15) moves up or down. After the loading process is completed, the air cylinders 388, 388 withdraw (direction $A_2$) the cam track 372, thereby releasing the cam rollers 359 and the conveyor chains 360, 362 move the X-Y tray away from the loading station of FIG. 15.

The mechanism for controlling the vertical position of the connecting plate 410 includes a servo motor 412 driving two gear boxes 414, 416 via a shaft 418. The shaft is coupled to the gear boxes by locking collars 420, 420. The gear boxes drive two timing disks 422, 424 through selected arcuate rotations. Connecting arms 426, 428 are connected to the timing disks 422, 424 at points 430, 432 and at their opposite ends 434 are connected 436 to the connector plate 410 via sliding housings 404, 406.

In operation, the servo motor 412 drives the timing disks 422, 424 through a predetermined arc or a number of predetermined arcs responsive to any suitable command, such as signals from a computer or micro processor. When the connecting points 430, 432 are at a twelve o'clock position, the connecting arms 426, 428 move the connecting plate 410 to its highest position. When servo motor 412 drives the timing disks 422, 424 and connecting points 430, 432 to three or nine o'clock positions, the connecting plate 410 is moved to an intermediate position. When the connecting points 430, 432 reach their lowest or six o'clock position, the connecting plate 410 is in its lowest position. The servo motor 412 may be operated to place connecting plate 410 at any suitable location within its range of possible travel.

Hence, assuming that the packaging machine is packing crackers in the configuration of FIG. 1B, the loader of FIG. 7 will have two tubes of crackers in each section 106 on the conveyor belt. An X-Y tray (FIG. 14) moves into the loading station (FIG. 15) and stops. The air cylinders 388, 388 cause the cam track 372 to engage cam roller 359. The servo motor 41 moves the support plate 410 and therefore elevator plate 300 to and through a number (such as three) of vertical positions. A separate layer of products is deposited on the elevator plate 300 at each vertical position. Then, air cylinders 388, 388 retract cam track and the X-Y tray moves on.

In the third embodiment of FIG. 21, the X-Y tray moves continuously, loading a layer in each of the areas marked $L_1$, $L_2$, $L_3$.

Those who are skilled in the art will readily perceive how to modify the invention. Therefore, the appended claims are to be construed to cover all equivalent structures which fall within the true scope and spirit of the invention.

The claimed invention is:

1. An automatic packaging machine for inserting a stack of layers of product into a carton, said machine comprising:

a tray having a somewhat U-shaped cross-section for carrying at least one layer of products to a carton, said U-shaped tray comprises a bottom elevator plate on which product is carried and a pair of side plates between which product is carried, said elevator plate and side plates together forming said somewhat U-shaped cross section, each of said plates having a comb-like structure, teeth in said comb-like structures on said pair of side plates interdigitating with teeth on opposite ends of said elevator plate, said trays being made wider or narrower by moving said side plates apart or together within a range set by a length of the teeth on said elevator plate, and said elevator plate moving up or down within a range set by the length of teeth on said side plates, means for selectively raising or lowering said elevator plate by incremental steps, each of said steps corresponding to the height of a layer of products, and means for placing a plurality of said products into said tray on each of said steps in order to form a layer of products on said elevator plate, said layer having a selected number of products whereby a tray can be loaded layer by layer in a step-by-step motion to receive and contain a stack of layers, each of said layers having said selected number of said products therein whereby all of said stacked layers can be inserted as a unit from said tray and into a box.

2. The machine of claim 1 and a servo motor, at least one timing disk driven by said servo motor, means responsive to an operation of said servo motor for selectively moving said timing disk through any of a plurality arcuate distances, and means responsive to the selective movement of said timing disk for selectively moving said elevator plate to a corresponding vertical location in said tray.

3. The machine of claim 1 and conveyor means for transporting a plurality of said trays over a path through said machine, a cam track extending along said conveyor means for at least part of said path, said cam track defining a plurality of levels, and means responsive to said cam track for raising or lower said elevator plate at each of said plurality of levels.

4. An X-Y tray for use in an automatic packaging machine, said tray having a U-shaped cross section with an open top, said U-shape being formed by an elongated elevator plate having a comb-like structure on opposite ends thereof, a pair of side plates, each of said side plates having a comb-like structure therein, teeth in the comb-like structure in each of said side plates interdigitating with teeth in the comb-like structure on a corresponding end of said elevator plate, said side plates sliding together or apart to receive product between them and said elevator plate moving up or down to receive product on an upper surface thereof, said side plate sliding and elevator plate moving being limited to distances which prevent the teeth in said comb-like structures from losing their interdigitated relationship, and means for selectively controlling said sliding of said side plates and said moving of said elevator plate for adjusting the width and depth of said tray in selected step-by-step incremental movements.

5. The X-Y tray of claim 4 wherein said means for controlling said depth of said tray comprises a servo motor, and means responsive to a selective operation of said servo motor for moving said elevator plate to a selected level.

6. The X-Y tray of claim 4 and a cam follower associated with said elevator plate, a cam track extending along at least part of a path followed by said X-Y tray, said cam follower riding along said cam track, and means responsive to an instantaneous position of said cam follower in said cam track for adjusting the elevation of said elevator plate.

7. An automatic packaging machine, said machine comprising a metering wheel, a plurality of teeth formed around the periphery of said metering wheel for defining pickup areas between them, means upstream of said metering wheel for delivering product to said metering wheel, metering means downstream of said metering wheel for receiving product delivered by said metering wheel grouped in batches corresponding to a number of products in a layer in a container, and means for stacking a selected plurality of said batches upon each other in order to provide a stacked number of layers of product for insertion as a unit into a container.

said stacking means comprising an X-Y tray having movable side and bottom walls, with interdigitating members at junctions of said side and bottom walls, for receiving said stacked batch of said products; means for changing a vertical relationship between said bottom and side walls of said X-Y tray and said metering means downstream of said metering wheel after said X-Y tray receives a batch of said product so that each succeeding batch received by said X-Y tray becomes a separate layer carried by said metering means downstream of said metering wheel, said separate layers being stacked upon other of said layers, for insertion as a unit in said container.

8. The machine of claim 7 wherein said downstream metering means comprises a belt with a plurality of upstanding fences periodically located thereon, a space between each of two adjacent ones of said fences defining between them a product receiving area, means for counting products delivered into said product receiving area as they are delivered by said metering wheel, and means responsive to a selected product count for periodically moving said metering belt to cause a preselected number of said products to be in each product receiving area as said batch of said product, each of said preselected number of products corresponding to the number of products in a layer in said container.

9. The machine of claim 7 wherein said X-Y tray has a variable width which gently moves a predetermined number of products together by enlarging a space between said side walls of said X-Y tray at least once to receive said product and then reducing said space between said side walls of said X-Y tray at least once to move said products together to fit into said container.

10. The machine of claim 7 wherein the width of said X-Y tray is cyclically and repeatedly enlarged and reduced to condition a product within said tray.

11. The machine of claim 7 further comprising means for carrying said bottom wall of said X-Y trays at a plurality of different levels relative to said container in order to insert the product into said X-Y trays at different levels to provide multi-layers of product for simultaneous insertion into said container.

* * * * *